US008080355B2

(12) United States Patent
Teshima et al.

(10) Patent No.: US 8,080,355 B2
(45) Date of Patent: Dec. 20, 2011

(54) LIQUID DEVELOPER AND IMAGE FORMING APPARATUS

(75) Inventors: Takashi Teshima, Shiojri (JP); Koji Akioka, North Adelaide (AU); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 979 days.

(21) Appl. No.: 12/032,568

(22) Filed: Feb. 15, 2008

(65) Prior Publication Data

US 2008/0199221 A1 Aug. 21, 2008

(30) Foreign Application Priority Data

Feb. 16, 2007 (JP) ..... 2007-036971
Nov. 6, 2007 (JP) ..... 2007-289085

(51) Int. Cl.
*G03G 9/00* (2006.01)

(52) U.S. Cl. ..... 430/113; 430/114; 430/116; 399/237

(58) Field of Classification Search ..... 430/113, 430/114, 116; 399/237
See application file for complete search history.

(56) References Cited

U.S. PATENT DOCUMENTS

| | | | |
|---|---|---|---|
| 6,029,036 | A | 2/2000 | Itaya et al. |
| 6,207,336 | B1 | 3/2001 | Itaya et al. |
| 7,563,552 | B2 | 7/2009 | Kaiho et al. |
| 2006/0204884 | A1 | 9/2006 | Teshima |
| 2007/0026338 | A1 | 2/2007 | Kaiho et al. |
| 2007/0248381 | A1 | 10/2007 | Akioka et al. |
| 2008/0003516 | A1 | 1/2008 | Akioka et al. |

FOREIGN PATENT DOCUMENTS

| | | | |
|---|---|---|---|
| EP | 1826619 | A2 | 8/2007 |
| EP | 1873592 | A2 | 1/2008 |
| JP | 07152256 | A | 6/1995 |
| JP | 2006251252 | A | 9/2006 |
| WO | 9508792 | A1 | 3/1995 |

*Primary Examiner* — Mark Chapman
(74) *Attorney, Agent, or Firm* — DLA Piper LLP (US)

(57) ABSTRACT

A liquid developer includes an insulation liquid containing a fatty acid monoester, and toner particles comprised of a polyester resin. By using the liquid developer, it is possible to provide superior fixing characteristic of toner particles to a recording medium. An image forming apparatus that can suitably use such a liquid developer is also provided.

12 Claims, 7 Drawing Sheets

LIQUID DEVELOPER AND IMAGE FORMING APPARATUS

BACKGROUND

1. Technical Field

The present invention relates to a liquid developer and an image forming apparatus, and in particular relates to a liquid developer and an image forming apparatus that can use the liquid developer.

2. Related Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof.

The other type of such a developer is known as a liquid developer (liquid toner) which is obtained by dispersing toner particles into a carrier liquid having electric insulation properties (one example of such a liquid developer is disclosed in JP-A 7-152256).

In the developing method using such a dry toner, since a solid state toner is used, there is an advantage in handleability thereof. On the other hand, however, this method involves problems in that an adverse effect against a human body is likely to be caused by toner powder, contamination is likely to be caused by dispersal of toner powder, and toner particles are likely to be massed together in a cartridge.

Further, in such a dry toner, since aggregation of toner particles is likely to occur in the producing process thereof, it is difficult to obtain toner particles each having a sufficiently small diameter. This means that it is difficult to form a toner image having high resolution.

Furthermore, there is also a problem in that when the size of the toner particle is made to be relatively small, the problems resulted from the powder form of the dry toner described above become more serious.

On the other hand, in the developing method using the liquid developer, since aggregation of toner particles in the liquid developer is effectively prevented, it is possible to use very fine toner particles and it is also possible to use a binder resin having a lower softening point (a low softening temperature) than a softening point of resin material used for a dry toner.

As a result, the method using the liquid developer has such advantages as good reproducibility of an image composed of thin lines, good tone reproducibility as well as good reproducibility of colors. Further, the method using the liquid developer is also superior as a method for forming an image at high speed.

However, the insulation liquid used in the conventional liquid developer is mainly composed of a petroleum-based carbon hydride. When such a liquid developer is used, an insulation liquid is adhering to a surface of each toner particle during fixing process of the toner particles.

In the conventional liquid developer, there is a problem in that such an insulation liquid adhering to the surfaces of the toner particles lowers fixing strength of the toner particles to a recording medium and thereby it is impossible to obtain a satisfactory fixing characteristic.

In order to solve such a problem as described above, it is attempted that plant-derived natural oil is used as an insulation liquid and an oxidation polymerization reaction of the oil is utilized for improving fixing strength of toner particles to a recording medium during the fixing process. One example of such a method is disclosed in JP-A 2006-251252.

However, in the liquid developer using the oil as described above, it has been possible to improve fixing strength to a recording medium to a certain level, but the improved fixing strength of the toner particles to a recording medium has not yet reached to a practically required level.

SUMMARY

Accordingly, it is an object of the present invention to provide a liquid developer which has superior fixing characteristic of toner particles to a recording medium and which has superior dispersibility of the toner particles. Further, it is also an object of the present invention to provide an image forming apparatus that can suitably use such a liquid developer.

These objects are achieved by the present invention described below.

In a first aspect of the present invention, there is provided a liquid developer which comprises an insulation liquid containing a fatty acid monoester, and toner particles comprised of a polyester resin.

In the liquid developer according to the present invention, it is preferred that the toner particles are characterized in that an average particle size of the toner particles is in the range of 0.7 to 3 μm, an average roundness R of the toner particles represented by the following formula (I) is in the range of 0.85 to 0.98, $$R=Lo/L_1 \quad \text{(I)}$$

wherein L1 [μm] represents a circumferential length of a projected image of a toner particle that is a subject of measurement, and Lo [μm] represents a circumferential length of a perfect circle having the same area as that of the projected image of the toner particle that is the subject of the measurement, and when a particle size distribution of the toner particles is measured in the volume basis to obtain a frequency distribution curve of the particle size distribution of the toner particles, an index S which indicates a sharpness of the frequency distribution curve of the particle size distribution of the toner particles represented by the following formula (II) is 1.4 or less, $$S=[D(90)-D(10)]/D(50) \quad \text{(II)}$$

wherein in the case where a cumulative distribution curve of the particle size distribution is plotted using a graph in which the ordinate axis represents a relative amount of the toner particles (%) with respect to the total amount of all the toner particles (100%) and the abscissa axis represents a particle size of a toner particle (μm), each of D(90), D(50) and D(10) respectively represents a particle size of a toner particle at a point of each of 90%, 50% and 10% of the relative amount of the toner particles in the cumulative distribution curve.

In the liquid developer according to the present invention, it is also preferred that the insulation liquid further contains at least one of an aliphatic hydrocarbon and a silicone oil in addition to the fatty acid monoester.

In the liquid developer according to the present invention, it is also preferred that an amount of the fatty acid monoester contained in the insulation liquid is in the range of 5 to 55 wt %.

In the liquid developer according to the present invention, it is also preferred that the fatty acid monoester exists at the vicinity of a surface of each of the toner particles in an unevenly distributed manner.

In the liquid developer according to the present invention, it is also preferred that the fatty acid monoester is an ester obtained from a fatty acid and a monovalent alcohol having 1 to 4 carbon atoms.

In the liquid developer according to the present invention, it is also preferred that the viscosity of the liquid developer which is measured according to JIS Z8809 using a vibration type viscometer at a temperature of 25° C. is in the range of 50 to 1000 mPa·s.

In a second aspect of the present invention, there is provided an image forming apparatus. The image forming apparatus is provided with a plurality of developing sections for forming a plurality of monochromatic color images using a plurality of liquid developers of different colors, a transfer section to which the plurality of monochromatic color images formed by the developing sections are sequentially transferred onto a recording medium while transferring the recording medium to form an unfixed image onto the recording medium by overlaying the transferred monochromatic color images one after another, and a fixing device for fixing the unfixed image onto the recording medium, wherein each of the plurality of liquid developers of different colors comprises an insulation liquid containing a fatty acid monoester and toner particles comprised of a polyester resin.

In a third aspect of the present invention, there is provided an image forming apparatus. The image forming apparatus is provided with a plurality of developing sections for forming a plurality of monochromatic color images using a plurality of liquid developers of different colors, an intermediate transfer section to which the plurality of monochromatic color images formed by the developing sections are sequentially transferred to form an intermediate transfer image which is formed by overlaying the transferred monochromatic color images one after another, a secondary transfer section for transferring the intermediate transfer image onto a recording medium to form an unfixed image onto the recording medium, and a fixing device for fixing the unfixed image onto the recording medium, wherein each of the plurality of liquid developers of different colors comprises an insulation liquid containing a fatty acid monoester and toner particles comprised of a polyester resin.

In the image forming apparatus according to the present invention, it is also preferred that each of the plurality of developing sections includes at least a developing roller having a surface on which a layer of the liquid developer is to be formed, a pressing unit which unevenly distributes the toner particles included in the layer at the vicinity of the surface of the layer, and a photoreceptor having a surface on which the corresponding monochromatic color image is to be formed by transferring the liquid developer on the developing roller.

In the image forming apparatus according to the present invention, it is also preferred that the pressing unit unevenly distributes the toner particles contained in the layer at the vicinity of the surface of the layer by applying an electrical field of a same polarity as that of the toner particles to the layer.

In the image forming apparatus according to the present invention, it is also preferred that each of the plurality of developing sections includes at least a developing roller having a surface on which a layer of the liquid developer is to be formed, a photoreceptor having a surface on which the corresponding monochromatic color image is to be formed by transferring the liquid developer on the developing roller, and an application roller which supplies the liquid developer to the developing roller, and wherein the application roller is of a type as Aniloxs Roller having a surface having grooves, and wherein the liquid developer is carried in the groves and thereby the liquid developer is supplied to the developing roller.

In the image forming apparatus according to the present invention, it is also preferred that the grooves formed on the surface of the application roller are formed inclinedly with respect to a rotational direction of the application roller.

According to the invention as described above, it is possible to provide a liquid developer which has superior fixing characteristic of toner particles to a recording medium and which has superior dispersibility of the toner particles. Further, it is possible to provide an image forming apparatus that can use such a liquid developer suitably.

DESCRIPTION OF EXEMPLARY EMBODIMENTS

Figure 1:
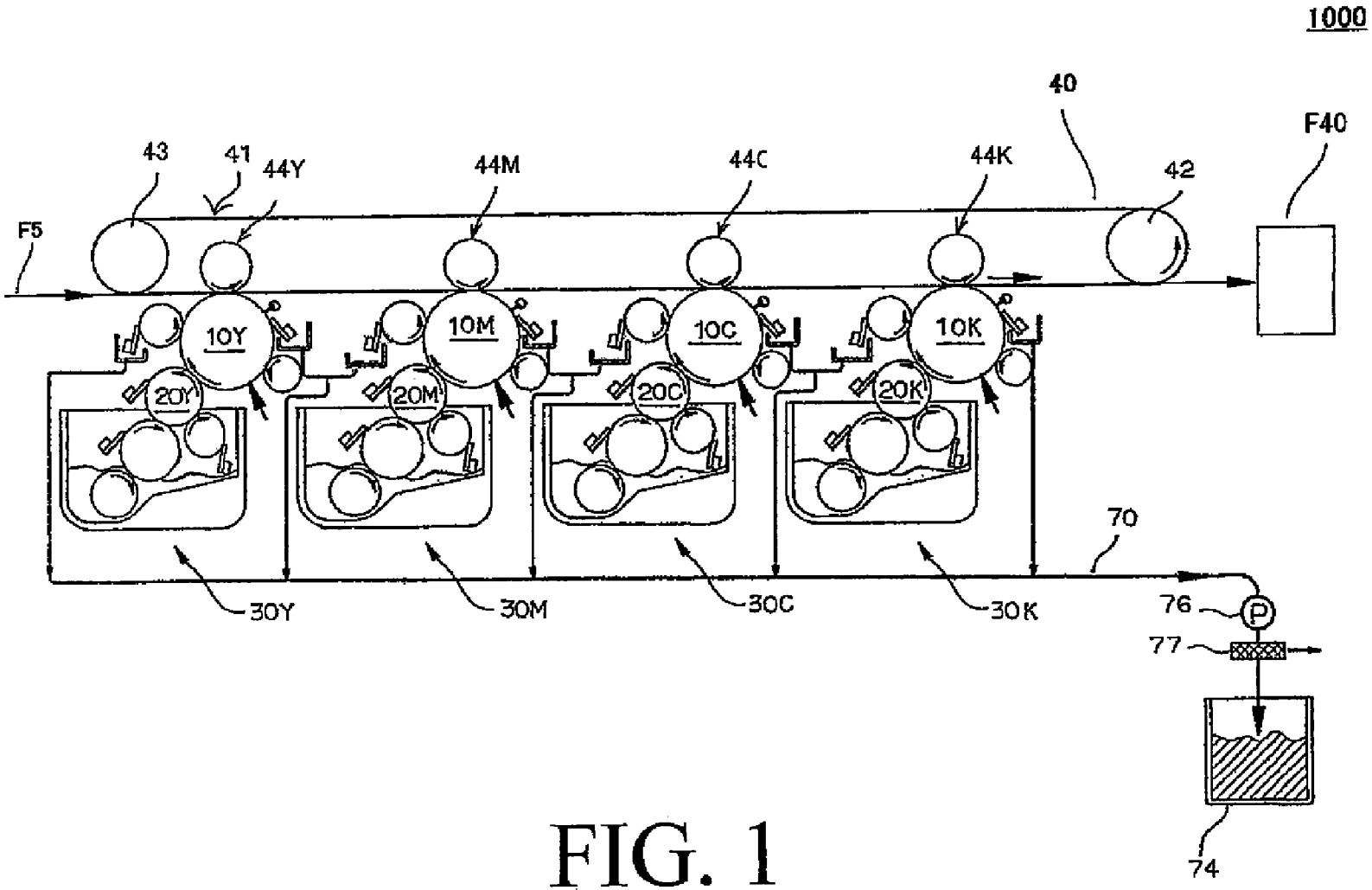
FIG. 1 is a schematic view which shows a first embodiment of an image forming apparatus to which the liquid developer of the present invention can be used.

Hereinbelow, with reference to the accompanying drawings, preferred embodiments of a liquid developer and an image forming apparatus according to the invention will be described in details.

Liquid Developer

First, a description will be made with regard to a liquid developer of the present invention. The liquid developer of the present invention includes an insulation liquid and toner particles dispersed in the insulation liquid. The toner particles are mainly comprised of a polyester resin.

Insulation Liquid

First, a description will be made with regard to the insulation liquid.

The insulation liquid used in the present invention includes a fatty acid monoester which is an ester obtained from a fatty acid and a monovalent alcohol.

As described above, in the conventional liquid developer, there is concern that an insulation liquid may give an adverse affect on the environment due to leakage of the insulation liquid out of an image forming apparatus during the use thereof (e.g. volatilization of an insulation liquid during a fixing process) and discard of the used liquid developer.

Further, in the conventional liquid developer, there is also a problem in that such an insulation liquid adhering to the surfaces of the toner particles lowers fixing strength of the toner particles to a recording medium.

In contrast with the conventional liquid developer described above, the fatty acid monoester used in the insulation liquid of the liquid developer of the present invention is a component harmless to the environment.

Therefore, it is possible to decrease a load to the environment by the insulation liquid which may be cased by leakage of the insulation liquid out of the image forming apparatus and discard of the used liquid developers. As a result, it is also possible to provide a liquid developer which is harmless to the environment.

In addition, such a fatty acid monoester has an effect capable of plasticizing a polyester resin constituting the toner particles (plasticizing effect) during the fixing process. Because of the plasticizing effect, when a paper is used as a recording medium, for example, the toner particles easily enter into gaps of paper fibers of the paper so that fixing property between the paper and the toner particles can be made excellent.

Further, because of this plasticizing effect, the toner particles are fused at a relatively low temperature and can be fixed onto the recording medium in such a fused state. Therefore, the liquid developer using the insulation liquid containing such a fatty acid monoester can be appropriately used in high speed image formation at a relatively low temperature.

Further, since the fatty acid monoester is a component which is easily impregnated into a recording medium, the fatty acid monoester adhering to the surfaces of the toner particles is immediately impregnated into the recording medium when the toner particles make contact with the recording medium during the fixing process.

Namely, a part of the polyester resin is also impregnated into the recording medium together with the fatty acid monoester. The impregnated polyester resin exhibits an anchoring effect against the recording medium to thereby further enhance the fixing strength of the toner particles to the recording medium.

As described above, the insulation liquid which contains the fatty acid monoester can exhibit the plasticizing effect of being capable of plasticizing the polyester resin constituting the toner particles during the fixing process.

Namely, in the liquid developer comprised of the insulation liquid containing the fatty acid monoester and the toner particles constituted from the polyester resin as a main component thereof, the fatty acid monoester is impregnated into the toner particles by heat or pressure during the fixing process appropriately and therefore it is possible to exhibit the plasticizing effect described above.

On the other hand, since the liquid developer is not heated and no pressure is not applied thereto during the preservation of the liquid developer, it is difficult for the fatty acid monoester to impregnate into the toner particles during the preservation of the liquid developer. As a result, it is possible to prevent aggregation of toner particles during the preservation of the liquid developer. And therefore it is possible to improve the fixing properties of the toner particles to a recording medium as well as preservability or storage stability of the liquid developer.

In the meantime, in the case where a full color image is to be formed, if liquid developers of different colors have large viscosity variation therebetween, color development of each of the colors becomes different in the obtained image and therefore there is a problem in that it is impossible to obtain a clear image.

In contrast, in the present invention, viscosity variation in the liquid developers of different colors can be made small by adding the fatty acid monoester into the insulation liquid of each of the liquid developers. As a result, it is possible to obtain a clear full color image having good color development balance between the different colors.

In other words, in the present invention, since the liquid developers of different colors can have small viscosity variation, it is possible to easily adjust the color development of each of the colors in an image to be obtained by adjusting development conditions thereof.

A fatty acid component constituting such a fatty acid monoester is not limited to any specific components. Examples of such a fatty acid component include: an unsaturated fatty acid such as oleic acid, palmitoleic acid, linoleic acid, α-linolenic acid, γ-linolenic acid, arachidonic acid, docosahexaenoic acid (DHA), eicosapentaenoic acid (EPA), and the like; a saturated fatty acid such as butyric acid, caproic acid, caprylic acid, capric acid, lauric acid, myristic acid, palmitic acid, stearic acid, arachidic acid, behenic acid, lignoceric acid, and the like; and the like. These fatty acid components may be used singly or in combination of two or more of them.

Among the fatty acid components mentioned above, in the case where the fatty acid monoester contains the saturated fatty acid as the fatty acid component, since the saturated fatty acid does not have unsaturated bonds, deterioration (oxidation or decomposition) of the fatty acid monoester is difficult to occur. As a result, the fatty acid monoester containing the saturated fatty acid (saturated fatty acid monoester) becomes chemically stable.

Therefore, the insulation liquid containing such a fatty acid monoester prevents occurrence of deterioration such as rising viscosity, changing color, lowering electric resistance value and the like for a long period of time reliably. As a result, it becomes possible to make preservability or storage stability of the liquid developer containing the insulation liquid more excellent.

As described above, the fatty acid monoester is transferred to the paper together with the toner particles during the fixing process, so that the saturated fatty acid monoester is contained in obtained toner images.

Therefore, since the saturated fatty acid monoester contained in the toner images is a component which is difficult to be deteriorated, even when the toner images are exposed in an external environment such as light, heat and oxygen, it is possible to prevent colors of the toner images containing the saturated fatty acid monoester from changing reliably, and therefore the obtained toner images can maintain its clearness for a long period of time.

In the case where the fatty acid monoester contains the saturated fatty acid as the fatty acid component, it is preferred that the saturated fatty acid has 8 to 16 carbon atoms. This makes it possible to exhibit the plasticizing effect of the fatty acid monoester effectively during the fixing process, thereby enabling the fixing property of the liquid developer to be more excellent.

Further, since the toner particles is surrounded with the fatty acid monoester having long chains of 8 to 16 carbon atoms for adhesion of the fatty acid monoester, it is possible to prevent aggregation of the toner particles during the preservation or storage of the liquid developer reliably.

In the case where the fatty acid monoester (unsaturated fatty acid monoester) which contains the unsaturated fatty acid as the fatty acid component is contained in the insulation liquid, it is possible to obtain the following effects.

Namely, it is possible to impregnate the unsaturated fatty acid monoester into the toner particles during the fixing process as described above, thereby exhibiting the plasticizing effect of the fatty acid monoester as is the same with the case where the saturated fatty acid monoester is contained in the fatty acid monoester as fatty acid component.

In addition to the above effect, since the unsaturated fatty acid monoester has unsaturated bonds, the unsaturated bonds cause oxidation polymerization reaction by heat and the like applied to the liquid developer during the fixing process.

As a result, the unsaturated fatty acid monoester is cured in itself for the polymerization of the unsaturated bonds, and thereby it is possible to improve fixing strength between the toner particles and the recording medium further. This makes it possible to exhibit the anchoring effect described above effectively, thereby enabling the fixing property of the liquid developer to be more excellent.

Such a fatty acid monoester is an ester obtained from a fatty acid and a monovalent alcohol, wherein it is preferred that the monovalent alcohol is alkyl alcohol having 1 to 4 carbon atoms. By using such an ester, it is possible to make chemical stability of the liquid developer excellent and it is also possible to make preservability or storage stability of the liquid developer more excellent.

Further, this also makes it possible to set the viscosity of the insulation liquid appropriately so that the liquid developer can be impregnated into a recording medium suitably. Examples of such a monovalent alcohol include methanol, ethanol, propanol, butanol, isobutanol, and the like.

A viscosity of the fatty acid monoester is preferably 10 mPa·s or less, and more preferably 5 mPa·s or less. By setting the viscosity of the fatty acid monoester to a sufficient low range, the fatty acid monoester can be impregnated into the recording medium more effectively.

Therefore, the impregnated fatty acid monoester can more reliably drag a part of a polyester resin of the toner particles plasticized by the plasticizing effect and fused by heat upon fixation, and a part of the fatty acid monoester existing in the vicinity of the surfaces of the toner particles are impregnated into the recording medium. As a result, the above-mentioned anchoring effect is achieved more reliably so that the fixing characteristic of the toner particles onto a recording medium can be improved.

Further, when the liquid developer is produced by using a method as described later, it is possible to obtain toner particles having uniform particle size appropriately. In this regard, it is to be noted that in this specification, the viscosity of the liquid developer is measured according to JIS Z8809 using a vibration type viscometer at a temperature of 25° C.

An aliphatic hydrocarbon may be contained in the insulation liquid as a constituent component thereof. The aliphatic hydrocarbon is a chemically stable liquid having high electric resistance. Therefore, the liquid developer containing the aliphatic hydrocarbon therein has especially excellent charge property and preservability, and therefore it is possible to obtain especially clear toner images having less defects and the like.

Further, since the aliphatic hydrocarbon has high affinity to the fatty acid monoester, it is easy for the aliphatic hydrocarbon can be easily impregnated into a recording medium such as paper and the like. Therefore, during the fixing process, the insulation liquid containing the aliphatic hydrocarbon and the fatty acid monoester can be immediately impregnated into the recording medium. This makes it possible to lower an amount of the aliphatic hydrocarbon and the fatty acid monoester contained in the insulation liquid existing on the recording medium, thereby enabling clear toner images to be obtained.

Since the aliphatic hydrocarbon is a hydrophobic compound, the aliphatic hydrocarbon is also a liquid having a low hygroscopic property. Therefore, in the case where the aliphatic hydrocarbon is used together with the fatty acid monoester as the insulation liquid, it is possible to prevent the insulation liquid from absorbing moisture during preservation or storage of the liquid developer reliably. It is also possible to prevent the insulation liquid from denaturing (deteriorating) more reliably. As a result, it is possible to exhibit more excellent preservability or storage stability.

Examples of the aliphatic hydrocarbon to be contained in the insulation liquid include, but not limited thereto, mineral oils such as ISOPER E, ISOPER G, ISOPER H, ISOPER L ("ISOPER" is a product name of Exxon Mobil Chemical), COSMO WHITE P-60, COSMO WHITE P-70, COSMO WHITE P-120 ("COSMO WHITE" is a product name of COSMO OIL LUBRICANTS Co., Ltd.), DIANA FRESIA W-8, DAPHNE OIL CP, DAPHNE OIL KP, TRANSFORMER OIL H, TRANSFORMER OIL G, TRANSFORMER OIL A, TRANSFORMER OIL B, TRANSFORMER OIL S ("DIANA FRESIA", "DAPHNE OIL" and "TRANSFORMER OIL" is a product name of Idemitsu Kosan Co., Ltd.), SHELLSOL 70, SHELLSOL 71 ("SHELLSOL" is a product name of Shell Chemical Japan Ltd.), Amsco OMS, Amsco 460 solvent ("Amsco" is a product name of Spirit Co., Ltd.), low-viscosity or high-viscosity liquid paraffin (produced by Wako Pure Chemical Industries, Ltd.), octane, isooctane, decane, isodecane, decalin, nonane, dodecane, isododecane, cyclohexane, cyclooctane, cyclodecane, and the like. These aliphatic hydrocarbons may be used singly or in combination of two or more of them.

Such an aliphatic hydrocarbon is preferably a saturated aliphatic hydrocarbon. Since such a saturated aliphatic hydrocarbon does not have unsaturated bonds, the saturated aliphatic hydrocarbon becomes a chemically stable liquid. As a result, electric resistance of the liquid developer containing the saturated aliphatic hydrocarbon is maintained at a high level for a long period of time.

It is preferred that such an aliphatic hydrocarbon also has at least one branched-chain of hydrocarbon group therein. Since this makes it possible for the aliphatic hydrocarbon to be stable due to its stereostructure of the aliphatic hydrocarbon, the aliphatic hydrocarbon becomes chemically stable. Therefore, by using the liquid developer containing such an aliphatic hydrocarbon, it becomes possible to make preservability or storage stability of the liquid developer more excellent.

This is supposed to result from the reason because the aliphatic hydrocarbon becomes a bulky structure in which a chemical reaction is difficult to occur.

Further, the insulation liquid may additionally contain a silicone oil as one of the components constituting the insulation liquid. Silicone oil is an organic compound having a skeleton of a siloxane bond. Generally, silicone oil has high electronic resistance.

Therefore, in the case where the silicone oil is used as one of the components constituting the insulation liquid, the liquid developer can have high electric resistance, so that it is possible to exhibit excellent properties such as transfer characteristic and development characteristic of the toner images.

Further, in the case where silicone oil in addition to the fatty acid monoester is contained in the insulation liquid, it becomes possible to fix the toner images at a high speed and a low temperature, thereby it is possible to make fixing strength of the obtained toner images excellent. This may be conceived as follows.

Silicone oil has compatibility with the fatty acid monoester, but low affinity to the polyester resin constituting the toner particles. Therefore, when the liquid developer contains the silicone oil and the fatty acid monoester, it is possible to impregnate the fatty acid monoester having high affinity to the polyester resin in the vicinity of surfaces of the toner particles.

As a result, it is possible to exhibit the plasticizing effect of the fatty acid monoester during the fixing process appropriately. Therefore, in the case where the toner images are fixed at a relatively low temperature and a high speed, it is believed that the toner images are fixed onto a recording medium firmly.

Further, since a viscosity of a silicone oil depends on the kind of a silicone oil to be used, it is possible to adjust the viscosity of the liquid developer by selecting an appropriate silicone oil.

Generally, since silicone oil is chemically stable and a substance which is less harmless to human body, it is possible to prevent the insulation liquid from deteriorating during the preservation or storage thereof. As a result, it is possible to make preservability or storage stability of the liquid developer excellent.

Further, since silicone oil has also low adverse effect to human body, even when the liquid developer leaks out of an image forming apparatus, the liquid developer is no harmless to human body.

Examples of silicone oil to be used to the insulation liquid include KF96, KF4701, KF965, KS602A, KS603, KS604, KF41, KF54, FA630 (produced by Shin-Etsu Chemical Co., Ltd.), TSF410, TFS433, TFS434, TFS451, TSF437 (produced by Momentive Performance Materials Japan, Inc.), SH200 (produced by TORAY INDUSTRIES, INC.), and the like. These silicone oils may be used singly or in combination of two or more of them.

An amount of the fatty acid monoester contained in the insulation liquid is preferably in the range of 5 to 55 wt %, more preferably in the range of 10 to 50 wt %, and even more preferably in the range of 20 to 50 wt %. If the amount of the fatty acid monoester is the above lower limit value or more, since the absolute amount of the fatty acid monoester contained in the insulation liquid is sufficiently high, it becomes possible for the fatty acid monoester to have a great chance of adhering on the surfaces of the toner particles. As a result, the plasticizer effect against the toner particles due to the fatty acid monoester is achieved more effectively so that the resin component of the toner particles can be impregnated into the recording medium more reliably.

Further, since the absolute amount of the fatty acid monoester contained in the insulation liquid is sufficiently high, the fatty acid monoester can be impregnated into the recording medium more reliably together with the fatty acid monoester. For these reasons, the above-mentioned anchoring effect is achieved more reliably so that the fixing characteristic of the toner particles onto a recording medium can be improved, namely the fixing strength of the formed toner image can be made especially excellent.

Furthermore, since the toner particles can be plasticized during the fixing process sufficiently, the plasticized toner particles are reliably fused with each other by contact between them. As a result, a toner image having especially excellent glaze can be formed.

Further in the case where an image is formed using a plurality of color toner particles, the adjacent different color particles are fused reliably. Therefore, in a region of a recording medium where the different color particles are fused, a plurality of colors derived from the different color particles are mixed so that the region can take on an intermediate color of the plurality of colors reliably. As a result, in the case where an image having a plurality of colors is formed by using the above liquid developers, a desired color tone of the image can be obtained more reliably.

In the case where the aliphatic hydrocarbon and/or the silicone oil are/is contained in the insulation in addition to the fatty acid monoester, mixing ratio of the fatty acid monoester and the aliphatic hydrocarbon and/or the silicone oil contained in the insulation is not particularly limited, but preferably satisfies the following relation.

Namely, when the amount of the fatty acid monoester contained in the insulation liquid is defined as X [wt %] and the amount of the aliphatic hydrocarbon and the silicone oil contained in the insulation liquid is defined as Z [wt %], it is preferred that the relation of $0.3 \leqq X/Z \leqq 9.0$ is satisfied, and more preferably the relation of $0.5 \leqq X/Z \leqq 4.0$ is satisfied. By satisfying such relationship, since it is possible to obtain a liquid developer having appropriate viscosity and sufficiently high electric insulation, it is possible to make the charge property of the liquid developer more excellent.

Further, the fatty acid monoester is impregnated into the toner particles during the fixing process as described above, and therefore it is also possible to exhibit the plasticizing effect of the fatty acid monoester more reliably. As a result, it is possible to make the fixing characteristic of the toner particles onto a recording medium particularly excellent.

Further, the insulation liquid may contain additional components other than the above-mentioned components. Examples of the additional components include decomposition products of fatty acid glyceride such as fatty acid triglyceride, glycerin, fatty acid, and the like, benzene, toluene, xylene, mesitylene, and the like. These additional components may be used singly or in combination of two or more of them.

Further, the liquid developer (insulation liquid) of the present invention may further contain a dispersant for improving a dispersibility of the toner particles.

Examples of such a dispersant include: polymer dispersants such as polyvinyl alcohol, carboxymethylcellulose, polyethylene glycol, Solsperse (trade name of LUBRIZOL JAPAN Ltd.), polycarboxylic acid, polycarboxylate, polyacrylic acid metal salts (e.g., sodium salts and the like), polymethacrylic acid metal salts (e.g., sodium salts and the like), polymaleic acid metal salts (e.g., sodium salts and the like), acrylic acid-maleic acid copolymer metal salts (e.g., sodium salts and the like), polystyrene sulfonate metal salts (e.g., sodium salts and the like), condensation polymer of polyamine fatty acid and the like; viscosity mineral, silica, tricalcium phosphate, tristearic acid metal salts (e.g., aluminum salts and the like), distearic acid metal salts (e.g., aluminum salts, barium salts and the like), stearic acid metal salts (e.g., calcium salts, lead salts, zinc salts and the like), linolenic acid metal salts (e.g., cobalt salts, manganese salts, lead salts, zinc salts and the like), octanoic acid metal salts (e.g., aluminum salts, calcium salts, cobalt salts and the like), oleic acid metal salts (e.g., calcium salts, cobalt salts and the like), palmitic acid metal salts (e.g., zinc salts and the like), dodecylbenzenesulfonic acid metal salts (e.g., sodium salts and the like), naphthenic acid metal salts (e.g., calcium salts, cobalt salts, manganese salts, lead salts, zinc salts and the like), resin acid metal salts (e.g., calcium salts, cobalt salts, manganese salts, lead salts, zinc salts and the like).

Since the condensation polymer of polyamine fatty acid has high affinity with a polyester resin constituting the toner particles among the dispersants mentioned above, it is likely to adhere to the vicinity of the surfaces of the toner particles, and thus it is possible to prevent aggregation (blocking) of the toner particles effectively. Further, the condensation polymer of polyamine fatty acid also has high affinity to the fatty acid monoester.

This makes it possible to make the dispersibility of the toner particles sufficiently high. As a result, it is also possible to make the preservability of the liquid developer excellent.

Further, the condensation polymer of polyamine fatty acid is also capable of making the impregnability of the fatty acid monoester contained in the insulation liquid into the toner particles sufficiently high, and thus the plasticizing effect of the fatty acid monoester can be exhibited more conspicuously.

As a result, it is possible to fix toner particles onto a recording medium more firmly, and thus it is also possible to make gloss of a toner image to be formed more excellent.

The condensation polymer of polyamine fatty acid contained in the liquid developer is a component having positive electrostatic property. Adhesion of such a component to the vicinity of the surfaces of the toner particles makes it possible to make the charge property of the toner particles sufficiently high.

In the case where the condensation polymer of polyamine fatty acid is used, an amount of the condensation polymer of polyamine fatty acid contained in the liquid developer is preferably in the range of 0.5 to 7.5 parts by weight with respect to 100 parts by weight of the toner particles, and more preferably in the range of 1 to 5 parts by weight with respect to 100 parts by weight of the toner particles.

This makes it possible to make the above effect obtained using the condensation polymer of polyamine fatty acid more conspicuous.

The insulation liquid may also contain an antioxidant therein.

Further, the liquid developer (insulation liquid) may further contain a charge control agent.

Examples of such a charge control agent include: metal oxides such as zinc oxide, aluminum oxide, magnesium oxide and the like; metal benzoates, metal salicylates, metal alkyl alicylates, catechol metal salts, bis azo dyes containing metal, nigrosin dyes, tetraphenyl borate derivatives, quaternary ammonium salts, alkylpyridinium salts, chlorinated polyesters, nitro phnic acid and the like.

The electric resistance of the insulation liquid at room temperature (20° C.) described above is preferably equal to or higher than $1\times10^{11}$ Ωcm, more preferably equal to or higher than $1\times10^{12}$ Ωcm, and even more preferably equal to or higher than $1\times10^{13}$ Ωcm.

Further, the dielectric constant of the insulation liquid is preferably equal to or lower than 3.5.

Toner Particles

Hereinbelow, a description will be made with regard to the toner particles.

Constituent Material of Toner Particles (Toner Material)

1 Polyester Resin

The toner particles (toner) contained in the liquid developer of the present invention are mainly constituted of a polyester resin.

The polyester resin has high transparency. Therefore, in the case where the polyester resin is used as the binder resin, color development of obtained images becomes excellent.

Since a chemical structure of the polyester resin is similar to a chemical structure of the fatty acid monoester as described above, the polyester resin has very high affinity to the fatty acid monoester. This makes it possible to disperse the toner particles constituted of the polyester resin in the liquid developer uniformly, and therefore it is possible to make the dispersibility of the toner particles in the liquid developer more excellent.

Further, since the polyester resin has very high affinity to the fatty acid monoester, the fatty acid monoester as described above can adhere to the surfaces of such toner particles reliably. Due to the adhesion of the fatty acid monoester to the surface of the toner particles, it is possible to exhibit the plasticizing effect of the fatty acid monoester more conspicuously as described above.

And therefore it is possible to impregnate the toner particles into the recording medium during the fixing process easily and to fuse the toner particles easily. As a result, it is possible to obtain a smooth toner image having smoothness with no irregularities, and therefore, thus obtained image can have especially excellent gloss and color.

The polyester resin is synthesized by dehydration condensation reaction of a polybasic acid and a polyvalent alcohol.

Examples of the polybasic acid include: aromatic carboxylic acid such as terephthalic acid, isophthalic acid, phthalic anhydride, trimellitic anhydride, pyromellitic acid, and naphthalene dicarboxylic acid; ariphatic carboxylic acid such as maleic anhydride, fumaric acid, succinic acid, alkenyl succinic anhydride, adipic acid and the like; cycloaliphatic carboxylic acid such as cyclohexane dicarboxylic acid and the like; and the like. These polybasic acids may be used singly or in combination of two or more of them.

Among the polybasic acids mentioned above, it is preferred that the aromatic carboxylic acid is used. This makes it possible to easily plasticize the toner particles by using the fatty acid monoester as described above.

Examples of the polyvalent alcohol include: aliphatic diol such as ethylene glycol, diethylene glycol, triethlene glycol, propylene glycol, butanediol, hexanediol, neopenthyl glycol, glycerin, trimethylolpropane, pentaerythritol, and the like; cycloaliphatic diol such as cyclohexanediol, cyclohexane dimethanol, and the like; aromatic diol such as water addition bisphenol A, ethyleneoxide addition bisphenol A, propyleneoxide addition bisphenol A, and the like; and the like. These polyvalent alcohols may be used singly or in combination of two or more of them.

Among the polyvalent alcohols mentioned above, the aromatic diol and the cycloaliphatic diol are preferable, and the aromatic diol is more preferable. This makes it possible to easily plasticize the toner particles using the fatty acid monoester as described above.

It is also preferred that the polyester resin has at least one amino group in a molecule thereof. By using such a polyester resin having the amino group, it is possible to easily plasticize the toner particles using the fatty acid monoester as described above. Further, since the amino group has positive electrostatic property, it is also possible to improve the positive electrostatic property.

In this regard, it is to be noted that by further adding monocarboxylic acid and/or monoalcohol to the obtained polyester resin so that a hydroxyl group and/or a carboxyl group of end groups of the polyester resin are reacted (esterified), it is possible to adjust acid numbers of the obtained polyester resin.

Examples of such a monocarboxylic acid include acetic acid, acetic anhydride, benzoic acid, trichloroacetic acid, trifluoroacetic acid, propionic anhydride, and the like. Examples of such a monoalcohol include methanol, ethanol, propanol, octanol, 2-ethyl-hexanol, trifluoroethanol, trichloroethanol, hexafluoroisopropanol, phenol, and the like.

Acid numbers of the polyester resin are preferably 15 KOHmg/g or less, and more preferably in the range of 0.5 to 12 KOHmg/g.

Further, the glass transition point of the polyester resin is preferably in the range of 15 to 70° C., and more preferably in the range of 20 to 55° C. Since the polyester resin is fused at a relatively low temperature, it is possible to make fixing property of the liquid developer at a low temperature more excellent, and it is also possible to make gloss of the formed images more excellent The softening point of the polyester resin is not particularly limited to any specific value, but it is preferably in the range of 50 to 130° C., more preferably in the range of 50 to 120° C., and even more preferably in the range of 60 to 115° C.

In this specification, the term "softening point" means a temperature at which softening is begun under the conditions that a temperature raising speed is 5° C./mim and a diameter of a die hole is 1.0 mm in a high-floored flow tester (manufactured by Shimadzu Corporation).

2 Coloring Agent

The toner particles of the liquid developer may contain a coloring agent. As for a coloring agent, it is not particularly limited, but pigments, dyes or the like can be used.

3 Other Components

In the toner particles, additional components other than the above components may be contained. Examples of such other components include wax, magnetic powder, and the like.

Further, the toner material (constituent material of the toner particles) may further contain zinc stearate, zinc oxide, cerium oxide, silica, titanium oxide, iron oxide, fatty acid, or fatty acid metal salt, or the like in addition to the components described above.

Shape of Toner Particles

The average particle size (diameter) of the toner particles constituted from the above described materials is preferably in the range of 0.7 to 3 μm, more preferably in the range of 0.8 to 2.5 μm, and even more preferably in the range of 0.8 to 2 μm.

If the average particle size of the toner particles is within the above range, it is possible to make properties variation of each of the toner particles small. As a result, it is possible to make resolution of a toner image formed from the liquid developer (liquid toner) sufficiently high while making the reliability of the obtaining liquid developer as a whole sufficiently high.

Further, it is also possible to improve dispersibility of the toner particles in the liquid developer to a satisfactory level, thereby making the preservability or storage stability of the liquid developer higher.

On the other hand, if the average particle size of the toner particles is smaller than the lower limit value noted above, properties variation of each of the toner particles becomes large and therefore it is not possible to provide a liquid developer having high reliability. As a result, there is the case that it is not possible to obtain a liquid developer having excellent development and transcriptional characteristics.

In addition, there is a fear that aggregation of the toner particles occurs during the preservation of the liquid developer, which may result in the case that sufficient preservability or storage stability of the liquid developer can not be obtained.

On the contrary, if the average particle size of the toner particles exceeds the upper limit value noted above, there is the case that it is not possible to make resolution of a toner image formed from the liquid developer sufficiently high.

Further, during the preservation or storage of the liquid developer, aggregation of the toner particles is likely to occur due to settle down of the toner particles, which may also result in the case that sufficient preservability or storage stability of the liquid developer can not be obtained. In this regard, it is to be noted that in this specification the term "average particle size" means an average particle size in volume basis.

Furthermore, in the toner particles contained in the liquid developer, an average roundness R represented by the following formula (I) is preferably in the range of 0.85 to 0.98, more preferably in the range of 0.90 to 0.98, and even more preferably in the range of 0.92 to 0.98.

$$R=L_0/L_1 \quad \text{(I)}$$

wherein $L_1$ (μm) represents the circumference of a projected image of a toner particle that is a subject of measurement, and $L_0$ (μm) represents the circumference of a perfect circle (a geometrically perfect circle) having the same area as that of the projected image of the toner particle that is a subject of measurement.

If the average roundness R of the toner particles falls within the above-noted range, since the fatty acid monoester of an appropriate amount can be retained in the vicinity of the surfaces of the toner particles, it is possible to exhibit the plasticizing effect as described above more effectively. As a result, it is possible to make the fixing characteristic of the toner particles to a recording medium higher. Further, it is also possible to make gloss of a toner image to be formed more excellent.

The presence of the fatty acid monoester of an appropriate amount in the vicinity of the surfaces of the toner particles makes it possible to easily disperse the toner particles into the insulation liquid during the preservation or storage of the liquid developer. As a result, it is possible to make dispersibility of the liquid developer containing the toner particles more excellent.

Further, the transfer efficiency and the mechanical strength of the toner particles can be made excellent while the particle size of the toner particles can be made sufficiently small.

In this case, it is preferred that a standard deviation of the average roundness among the toner particles is 0.15 or less, more preferably in the range of 0.001 to 0.10, and even more preferably in the range of 0.001 to 0.05. When the standard deviation of average roundness among the toner particles lies within the above range, variations in charge properties, fixing properties, etc can be made especially small, thereby further improving reliability of the liquid developer as a whole.

When a particle size distribution of the toner particles is measured in the volume basis to obtain a frequency distribution curve of the particle size distribution of the toner particles, an index S which indicates a sharpness of the frequency distribution curve of the particle size distribution of the toner particles represented by the following formula (II) is preferably 1.4 or less, more preferably 1.3 or less, and even more preferably 1.2 or less, $$S=[D(90)-D(10)]/D(50) \quad \text{(II)}$$

wherein in the case where a cumulative distribution curve of the particle size distribution is plotted using a graph in which the ordinate axis represents a relative amount of the toner particles (%) with respect to the total amount of all the toner particles (100%) and the abscissa axis represents a particle size of a toner particle (μm)), each of D(90), D(50) and D(10) respectively represents a particle size of a toner particle at a point of each of 90%, 50% and 10% of the relative amount of the toner particles in the cumulative distribution curve.

If the index S of the particle size distribution of the toner particles falls within the above range, variations in the particle size of the toner particles can be made small. Namely, most of the toner particles contained in the total toner particles have the same particle size.

Therefore, in the case where the liquid developer is dipped from a development container by an application roller and the like, the most of toner particles are arranged in contact with each other through adequately gaps each having a predetermined size. As described above, since most of the toner particles contained in the total toner particles have the same particle size, most of toner particles do not enter into the gaps. As a result, since the insulation liquid can enter into the gaps reliably, an appropriate amount of the insulation liquid can adhere to the surfaces of the toner particles, thereby it is possible to carry out transfer of a latent image and development thereof efficiently.

As described above, since the appropriate amount of the insulation liquid (fatty acid monoester) exists on the surfaces of the toner particles as well as in the gaps between the toner particles, it is possible to make fixing strength of the toner particles excellent during the fixing process due to the plasticizing effect as described above.

Additionally, since variations in particle size of the toner particles are small, it is easy for the toner particles to be applied pressure and heated during the fixing process uniformly. As a result, the toner particles are fused uniformly, thereby a toner image of a desired color tone can be obtained more reliably.

Further, due to the uniform fusion of the toner particles, it is possible to form a toner image having superior smoothness, thereby enabling the toner image to have high gloss.

On the other hand, if the index S of the particle size distribution of the toner particles exceeds the upper limit value described above, variations in the particle size of the toner particles become large. Therefore, when the toner particles each having a large particle size are in contact with each other, gaps between the toner particles also become large so that the toner particles of the small particle size are likely to enter into the gaps, thereby narrowing the gaps.

As a result, in the case where the liquid developer is dipped from the developer container by the application roller and the like, since the gaps are small, the toner particles are short of an amount of the insulation liquid adhering the surfaces thereof and amount of the insulation liquid held by the gaps also becomes small, so that it becomes impossible to carry out transfer of a latent image and development thereof efficiently.

Further, in the case where variations in particle size of each of the toner particles are large, it is difficult for the toner particles to be applied pressure and heated during the fixing process uniformly. As a result, the toner particles are not fused uniformly, thereby a toner image of a desired color tone can not be obtained.

Furthermore, since the uniform fusion of the toner particles can not be made, smoothness of a toner image is lowered, which result in the toner image having poor gloss.

An amount of the toner particles contained in the liquid developer is preferably in the range of 10 to 60 wt %, and more preferably in the range of 20 to 50 wt %. This makes it possible to reliably prevent the fatty acid monoester and the dispersant from separating by the contact between the toner particles during the preservation or storage of the liquid developer, thereby enabling the fixing property and charge property of the liquid developer to be excellent.

Further, this also makes it possible to adjust the viscosity of the liquid developer appropriately and moderate conditions such as heating and the like during the fixing process.

The viscosity of the liquid developer is preferably in the range of 20 to 400 mPa·s, and more preferably in the range of 30 to 35 mPa·s. If the viscosity of the liquid developer falls within the above range, it is possible to make dispersibility of the toner particles higher. It is also possible to supply the liquid developer to an application roller more uniformly in the image forming apparatus as described later.

Further, it is also possible to prevent dripping and the like of the liquid developer from being caused from the application roller and the like effectively.

In the case where a plurality of liquid developers of different colors are used, difference between the highest viscosity and the lowest viscosity among those of the plurality of the liquid developers is preferably 250 mPa·s or less, and more preferably 220 mPa·s or less. This makes it possible to form clear images.

Further, the electric resistance of the liquid developer constituted of the components as described above that is, the liquid developer of the present invention, at room temperature (20° C.), is preferably $1\times10^{12}$ Ωcm or higher, and more preferably $2\times10^{12}$ Ωcm or higher.

Method of Producing Liquid Developer

Hereinbelow, a preferred embodiment of a method of producing a liquid developer of the present invention will be described. In this regard, it is to be noted that the following description of the embodiment will be made based on the case that an insulation liquid contains a fatty acid monoester and other components.

The liquid developer producing method of this embodiment includes an associated particle formation step of associating resin fine particles mainly constituted of a polyester resin to obtain associated particles, a step of obtaining toner particles which are obtained by disassociating the associated particles in the fatty acid monoester, and a mixing step of mixing the thus obtained toner particles and the other components constituting an insulation liquid.

Production of Associated Particles

Hereinbelow, a description will be made with regard to one example of a method of producing associated particles which are formed by associating resin fine particles mainly constituted of a polyester resin.

The associated particles may be formed by various methods. In this embodiment, a water-based emulsion comprised of a water-based dispersion medium constituted of a water-based liquid and a dispersoid (fine particles) constituted of a resin material (toner material) and dispersed in the water-based dispersion medium is first prepared, and then the dispersoid in the water-based emulsion is associated to thereby obtain the associated particles.

Water-Based Emulsion

First, a description will be made with regard to the water-based emulsion to be used in this embodiment. The water-based emulsion obtained in a step of preparing the water-based emulsion described later is comprised of a water-based dispersion medium constituted from a water-based liquid and a dispersoid (fine particles) dispersed in the water-based dispersion medium finely.

Water-Based Dispersion Medium (Water-Based Liquid)

In the present invention, the water-based dispersion medium is constituted from a water-based liquid. In the present invention, the term "water-based liquid" means a liquid constituted from water and/or a liquid having good compatibility with water (for example, a liquid having a solubility of 30 g or higher with respect to water of 100 g at 25° C.).

As described above, the water-based liquid is constituted from water and/or a liquid having good compatibility with water, but it is preferred that the water-based liquid is mainly constituted from water. Preferably, the water content is 70 wt % or more, and more preferably the water content is 90 wt % or more.

By using such a water-based liquid, it is possible to increase the dispersibility of the dispersoid in the water-based dispersion medium and it is also possible to make the dispersoid in the water-based emulsion have small particle size and small particle size variation. As a result, the toner particles in the finally obtained liquid developer can have small variation in their particle size and shape and large roundness.

Further, it is also preferred that the water-based dispersion medium (water-based liquid) has low compatibility with an insulation liquid having high insulation property (for example, a liquid having a solubility of 0.01 g or lower with respect to the insulation liquid having high insulation property of 100 g at 25° C.).

By using such a water-based dispersion medium, it becomes possible to keep the shape of the dispersoid (fine particles) appropriately in a water-based emulsion obtained in a preparing water-based emulsion step described later, and this makes it possible for toner particles contained in the finally obtained liquid developer to have more uniform shape.

Examples of such a water-based liquid include water, alcohol-based solvent such as methanol, ethanol, propanol, and the like; ether-based solvent such as 1,4-dioxane, tetrahydrofuran (THF), and the like; aromatic heterocyclic compound-based solvent such as pyridine, pyrazine, pyrrole, and the like; amide-based solvent such as N,N-dimethylformamide (DMF), N,N-dimethylacetamide (DMA), and the like; nitrile-based solvent such as acetonitrile, and the like; and aldehyde-based solvent such as acetaldehyde, and the like.

Dispersoid (Fine Particles)

The dispersoid contains the components which constitute the toner particles as described above. The dispersoid may further contain a solvent that can dissolve a part of the components constituting the dispersoid.

By using such a dispersoid, it is possible to increase the fluidity of the dispersoid in the water-based emulsion and thus it is also possible to make the dispersoid have small particle size and small particle size variation in the water-based emulsion. As a result, the toner particles in the finally obtained liquid developer can have small particle size variation and large roundness.

Various solvents may be employed if they can dissolve a part of the components constituting the dispersoid, but it is preferable to use a solvent having a boiling point lower than that of the water-based liquid. This makes it possible to remove the solvent from the dispersoid easily.

Further, it is also preferred that the solvent has low compatibility with the water-based dispersion medium (water-based liquid) (for example, a liquid having a solubility of 30 g or lower with respect to the water-based liquid of 100 g at 25° C.). This makes it possible for the dispersoid (toner material) to be finely dispersed in the water-based emulsion in a stable manner.

Further, a composition of the solvent can be selected appropriately according to the compositions of the coloring agent to be used, the compositions of the water-based dispersion medium to be used or the like as described above.

Such a solvent is not particularly limited to any specific kinds of solvent, but either of an inorganic solvent or an organic solvent can be used as the solvent. Examples of such an organic solvent include ketone solvent such as methyl ethyl ketone (MEK), aromatic hydrocarbon solvent such as toluene, and the like.

Further, an emulsion dispersant may be contained in the water-based emulsion.

By using the emulsion dispersant as described above in preparing the water-based emulsion, it is possible to improve the dispersibility of the dispersoid. Further, it is also possible to make variations in shape and size of the dispersoid in the water-based emulsion particularly small relatively easily, and also possible to make the shape of each dispersoid roughly spherical shape.

With these results, it is possible to obtain a liquid developer which is constituted of toner particles each formed into a roughly spherical shape and having uniform shape and size. In this regard, examples of the emulsion dispersant include commonly used emulsifiers, commonly used dispersants, and the like An amount of each of the emulsion dispersant and the dispersant (emulsion dispersant) contained in the water-based emulsion is not particularly limited, but it is preferably 3.0 wt % or less, and more preferably in the range of 0.01 to 1.0 wt %, respectively.

Further, a dispersion auxiliary agent may be contained in the water-based emulsion. Examples of the dispersion auxiliary agent include an anionic surfactant, a cationic surfactant, a nonionic surfactant, and the like.

It is preferred that the dispersion auxiliary agent is used together with the dispersant (emulsion dispersant). In the case where the dispersoid is contained in the water-based emulsion, an amount of the dispersion auxiliary agent in the water-based emulsion is not particularly limited to any specific value, but is preferably 2.0 wt % or less, and more preferably in the range of 0.005 to 0.5 wt %.

Further, components other than the components constituting the dispersoid may be dispersed in the water-based emulsion as insoluble matters. Examples of such insoluble matters include: inorganic fine powder such as silica, titanium oxide, ferric oxide, and the like; organic fine powder such as fatty acid, fatty acid metal salt, and the like.

In the water-based emulsion to be used in this embodiment as described above, since the dispersoid is dispersed in a liquid sate in the water-based emulsion, there is a tendency that the dispersoid having the large roundness (sphericity) is obtained by surface tension by itself. Therefore, the toner particles in the finally obtained liquid developer can have especially large roundness and especially small particle shape variation.

An amount of the dispersoid contained in the water-based emulsion is not particularly limited, but preferably it is in the range of 5 to 55 wt %, and more preferably in the range of 10 to 50 wt %. This makes it possible to prevent bonding or aggregation of particles of the dispersoid in the water-based emulsion more reliably, thereby enabling productivity of the toner particles (liquid developer) to be particularly excellent.

An average diameter of the particles of the dispersoid in the water-based emulsion is not particularly limited, but preferably it is in the range of 0.01 to 3 μm, and more preferably in the range of 0.1 to 2 μm. This makes it possible to make the size of the toner particles finally obtained optimum. In this regard, it is to be noted that the term "average diameter" means an average size of the particles in volume basis.

Step of Preparing Water-Based Emulsion

The water-based emulsion as described above is prepared as follows (step of preparing the water-based emulsion).

First, an aqueous solution is prepared by adding a dispersant into the water-based liquid as needed.

On the other hand, a resin solution containing a polyester resin (dispersoid) which is used as a main component of the toner particles as described above is prepared.

The resin solution may contain the solvent described above in addition to the polyester resin. The resin solution may also be in a liquid state that the polyester resin contained therein is being fused by heating.

In preparing the resin solution, a kneaded material obtained by kneading the toner material such as the polyester resin, the coloring agent and the like may be used.

By using such a kneaded material as described above, even in the case where the constituent material of the liquid developer contains components which are difficult to be dispersed or dissolved to each other, it is possible to obtain a material that the components thereof are mutually dissolved and finely dispersed in a satisfactory level in the kneaded material obtained by the kneading process.

In particular, in the case where a pigment (coloring agent) having relatively low dispersibility to a solvent as described above is used, a periphery of each particle of the pigment is effectively coated with the polyester resin of the kneaded material during the kneading process carried out before the dispersion to the solvent.

This makes it possible to improve dispersibility of the pigment to the solvent (particularly, it becomes possible to finely disperse the particles of the pigment in the solvent). As a result, the finally obtained liquid developer can exhibit excellent color development.

Accordingly, even in the case where the constituent material of the toner particles contains a component having poor dispersibility to the water-based dispersion medium of the water-based emulsion and/or a component having poor solubility to the solvent contained in the water-based dispersion medium of the water-based emulsion, it is possible to make the dispersibility of the dispersoid contained in the water-based emulsion especially excellent.

Next, the resin solution is added drop by drop to the aqueous solution with being stirred. As a result, it is possible to obtain the water-based emulsion comprised of the water-based liquid (water-based dispersion medium) and the dispersoid comprised of the polyester resin in the form of fine particles which is dispersed in the water-based liquid.

The preparation of the water-based emulsion by using such a method makes it possible to heighten the roundness of the dispersoid (toner particles) in the water-based emulsion further. As a result, the toner particles in the finally obtained liquid developer can have small particle size variation. In this regard, it is to be noted that when the resin solution is added drop by drop, the aqueous solution and/or the resin solution may be heated.

Further, in the case where the solvent is used for preparing the resin solution, after the resin solution is added drop by drop to the aqueous solution, by heating the thus obtained water-based emulsion or placing it under reduced pressure, at least a part of the solvent contained in the water-based emulsion may be removed.

Alternatively, a water-based emulsion may be obtained by the following method. Namely, a water-based liquid is mixed with a resin solution by adding the water-based liquid drop by drop into the resin solution with the resin solution being stirred with an agitator and the like so that phase-inversion emulsification occurs in the resin solution.

In this way, a dispersion liquid (water-based emulsion) in which the dispersoid contained in the resin solution is dispersed is obtained finally. This makes it possible to easily and reliably obtain a water-based emulsion in which the dispersoid is dispersed uniformly and finely.

Step of Forming Associated Particles

Next, an electrolyte is added to the water-based emulsion obtained by the processes as described above so that the fine particles of the dispersoid are associated to thereby form associated particles (Step of forming associated particles).

Examples of an electrolyte to be added include: acidic substances such as hydrochloric acid, sulfuric acid, phosphoric acid, acetic acid, oxalic acid and the like; organic or inorganic soluble salts such as sodium sulfate, ammonium sulfate, potassium sulfate, magnesium sulfate, sodium phosphate, sodium dihydrogen phosphate, sodium chloride, potassium chloride, ammonium chloride, calcium chloride, sodium acetate and the like. These electrolytes can be used singly or in combination of two or more.

Among these electrolytes, sulfate salts of monovalent cation such as potassium sulfate, ammonium sulfate and the like are preferably used because association of the fine particles is carried out uniformly.

Further, before the electrolyte is added to the water-based emulsion, an inorganic dispersion stabilizer such as hydroxyapatite, ionic surfactant, nonionic surfactant and the like may be added to the water-based emulsion. By adding the electrolyte to the water-based emulsion under the existence of the dispersion stabilizer (emulsifier), it is possible to prevent ununiform association.

Examples of such a dispersion stabilizer include: nonionic surfactants such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, various pluronic types and the like; anionic surfactants such as alkyl sulfate ester salt types; cationic surfactants such as quaternary ammonium salt types; and the like.

Among these dispersion stabilizers, anionic surfactants and nonionic surfactants are preferably used because of being capable of exhibiting the excellent dispersibility with the addition of a small amount thereof. A cloud point of the nonionic surfactants is preferably equal to or higher than 40° C.

An amount of the electrolyte to be added is preferably in the range of 0.5 to 15 parts by weight, more preferably in the range of 1 to 12 parts by weight, even more preferably in the range of 1 to 10 parts by weight with respect to 100 parts by weight of solid components of the water-based emulsion.

If the amount of the electrolyte is lower than the lower limit value, there is a case that association of the dispersoid does not progress sufficiently.

Further, if the amount of the electrolyte exceeds the higher limit value, association of the dispersoid becomes ununiform. As a result, there is a possibility that coarsened particles are produced in the water-based emulsion, and thereby the size of toner particles finally obtained becomes uneven.

The step of forming the associated particles may be carried out after the step of preparing the water-based emulsion. Alternatively, the step of forming the associated particle may be carried out after preparing the water-based emulsion and then storing the obtained water-based emulsion. In the latter case, a storage period is not particularly limited, but if the storage period is within 10 days, it is possible to narrow an index S which indicates a sharpness of the frequency distribution curve of a particle size distribution of the obtained associated particles in particular.

Next, after associating the fine particles of the dispersoid, associated particles are obtained with a solid state by filtering, washing, and drying them.

An average particle size of the obtained associated particles is preferably in the range of 0.1 to 7 μm, and more preferably in the range of 0.5 to 3 μm. This enables toner particles finally obtained to have an appropriate particle size.

Disassociating Step (Step of Obtaining Toner Particle Dispersion Liquid)

Next, the associated particles are disassociated in a fatty acid monoester to thereby obtain a toner particle dispersion liquid comprised of the toner particles dispersed in the fatty acid monoester.

As described above, the fatty acid monoester is a component which has high affinity to the polyester resin. Therefore, when the associated particles are disassociated in the fatty acid monoester, the fatty acid monoester can easily enter between fine particles (dispersoid) constituting the associated particles so that it is possible to disassociate the associated particles with a smaller energy efficiently.

Further, by disassociating the associated particles in the fatty acid monoester in this way, the fatty acid monoester contained in the insulation liquid can adhere (exist) on the surfaces of each of the toner particles in the liquid developer finally obtained.

By allowing the fatty acid monoester to adhere or exist on the surfaces of each of the toner particles in this way, the above-described plasticizing effect becomes more conspicuous. As a result, since the toner particles can easily enter into gaps of paper fibers (recording medium), it is possible to make fixing strength of the toner particles more excellent.

Further, since the associated particles are disassociated in a liquid, that is, in the fatty acid monoester, it is possible to prevent production of toner particles coarsened by the aggregation and the like.

Further, since the obtained toner particles have gaps or irregularities derived from the fine particles (dispersoid) on the surfaces thereof, the fatty acid monoester is retained in the gaps reliably.

Further, in this embodiment, since the toner particles are obtained by disassociating the associated particles, it is possible to prevent generation of fine powder (extremely fine particles which are smaller than the particles having a target particle size) as compared to the case where the conventional disassociating method or wet crushing method is used. As a result, it is possible to effectively prevent deterioration of the charge property of the liquid developer due to the presence of the fine powder.

Further, since the fatty acid monoester has relatively lower viscosity, the fatty acid monoester can easily enter into gaps between the fine particles constituting each of the associated particles, and thus it is possible to disassociate the associated particles relatively easily.

In this regard, it is preferred that a condensation polymer of polyamine fatty acid is added into the fatty acid monoester before the fatty acid monoester is mixed with the associated particles. When such a condensation polymer of polyamine fatty acid is added, it acts as a grinding aid and therefore it is possible to disassociate the associated particles more efficiently. Further, it is also possible to make the dispersibility of the obtained toner particles higher.

Further, since the condensation polymer of polyamine fatty acid is added in the fatty acid monoester contained in the insulation liquid, the condensation polymer of polyamine fatty acid can adhere to the surfaces of the toner particles. As a result, it is possible to make charge property of the liquid developer higher.

Furthermore, adhesion of the condensation polymer of polyamine fatty acid to the surface of each of the toner particles makes it possible for the fatty acid monoester to exist at the vicinity of the surface of each of the toner particles in an unevenly distributed manner reliably.

Mixing Step

Next, the thus obtained toner particle dispersion liquid is mixed with the other components constituting the insulation liquid, so that the insulation liquid in which the toner particles are dispersed is obtained (Mixing step).

Through the processes as described above, it is possible to obtain a liquid developer of the present invention which is comprised of an insulation liquid and toner particles dispersed in the insulation liquid, wherein the insulation liquid contains a fatty acid monoester and the toner particles mainly constituted of a polyester resin.

In this regard, it is to be noted that the associated particles are disassociated in the fatty acid monoester in the embodiment described above, but the associated particles may be disassociated in a mixture solution in which the fatty acid monoester is mixed with the other components constituting the insulation liquid. Even when the associated particles are disassociated in such a mixture solution, it is possible to obtain the effects as described above.

Further, it is to be noted that the insulation liquid contains the fatty acid monoester and the other components in the embodiment described above, but in the case where the insulation liquid is constituted of only the fatty acid monoester, it is possible to omit the mixing step described above from the steps for producing the liquid developer.

First Embodiment of Image Forming Apparatus

Next, a description will be made with regard to a first embodiment of an image forming apparatus of the present invention.

The image forming apparatus of the present invention is an apparatus which forms color images on a recording medium by using the liquid developer of the present invention as described above.

Figure 2:
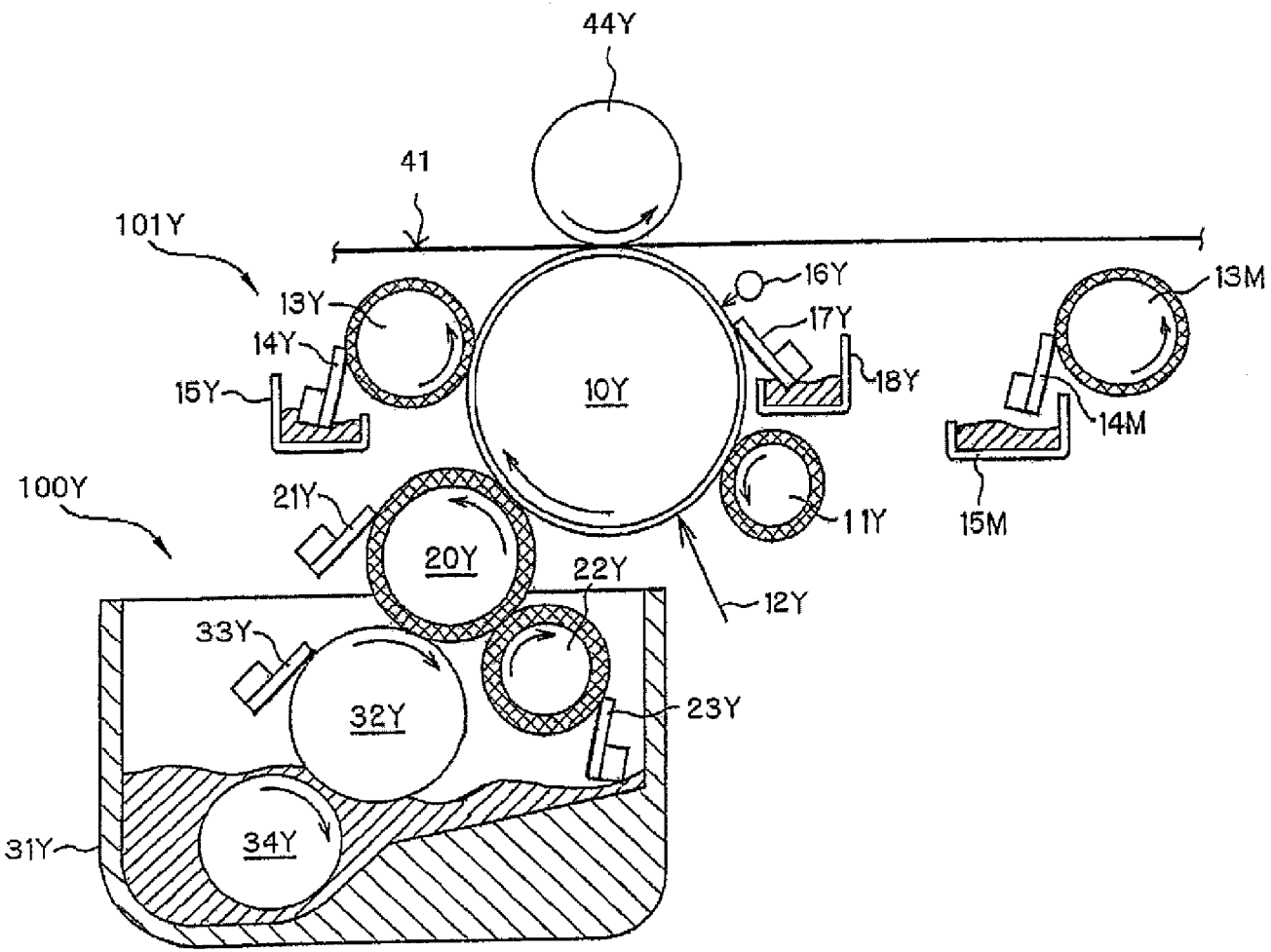
FIG. 2 is an enlarged view of a part of the image forming apparatus shown in FIG. 1.
Figure 3:
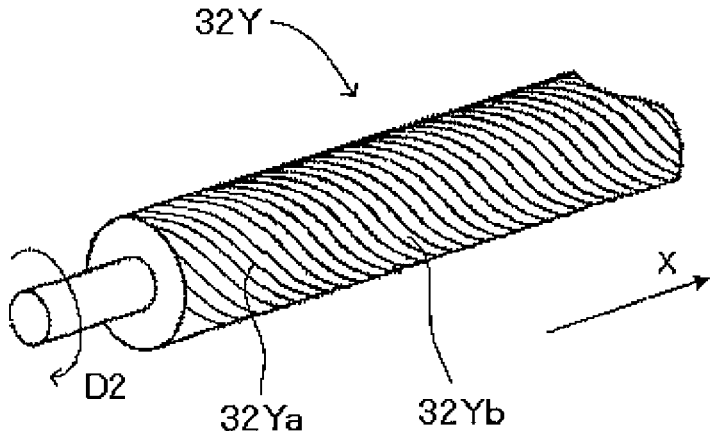
FIG. 3 is a schematic perspective view which shows an application roller provided in the image forming apparatus shown in FIG. 1.
Figure 4:
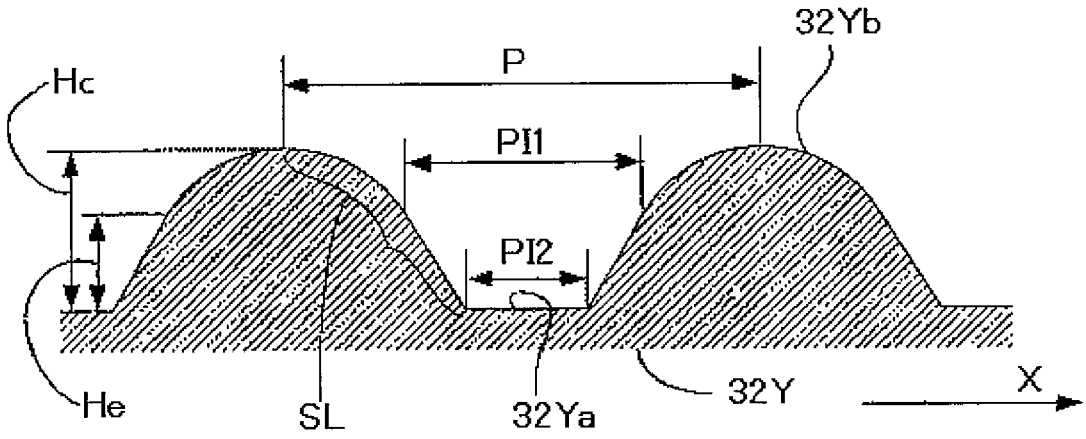
FIG. 4 is an enlarged schematic view of the application roller shown in FIG. 3.
Figure 5:
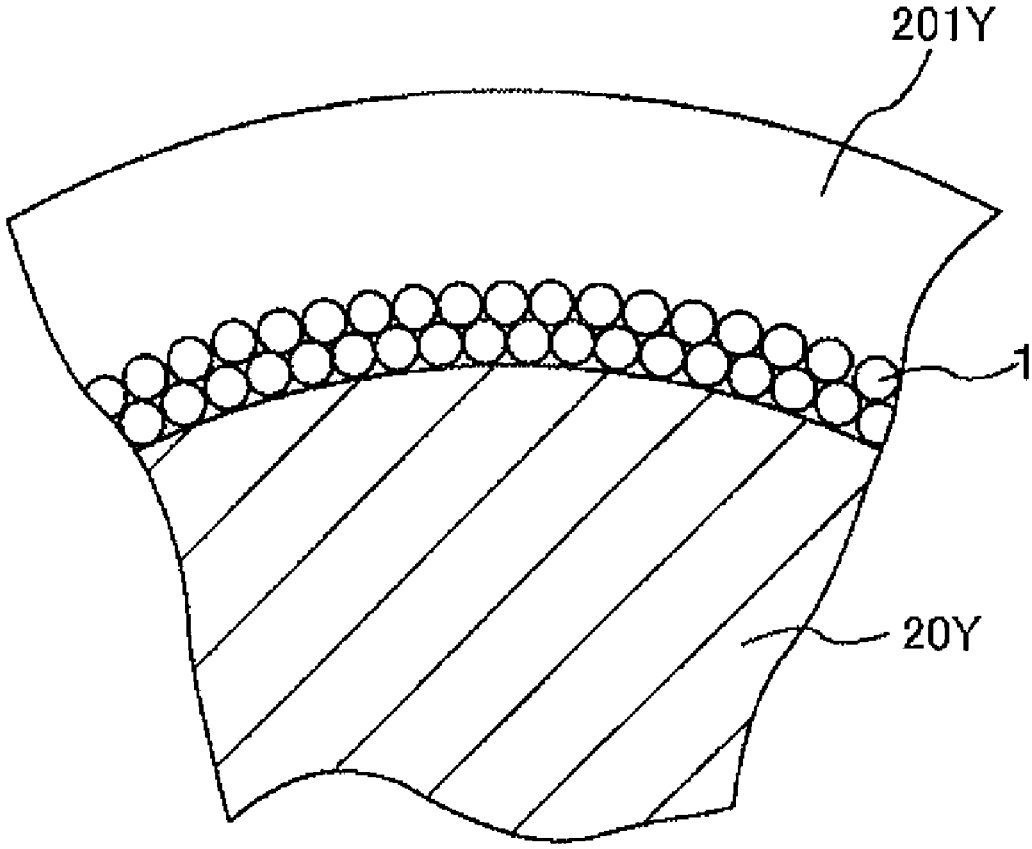
FIG. 5 is a schematic view which shows a state of toner particles in a layer of the liquid developer on the developing roller.
Figure 6:
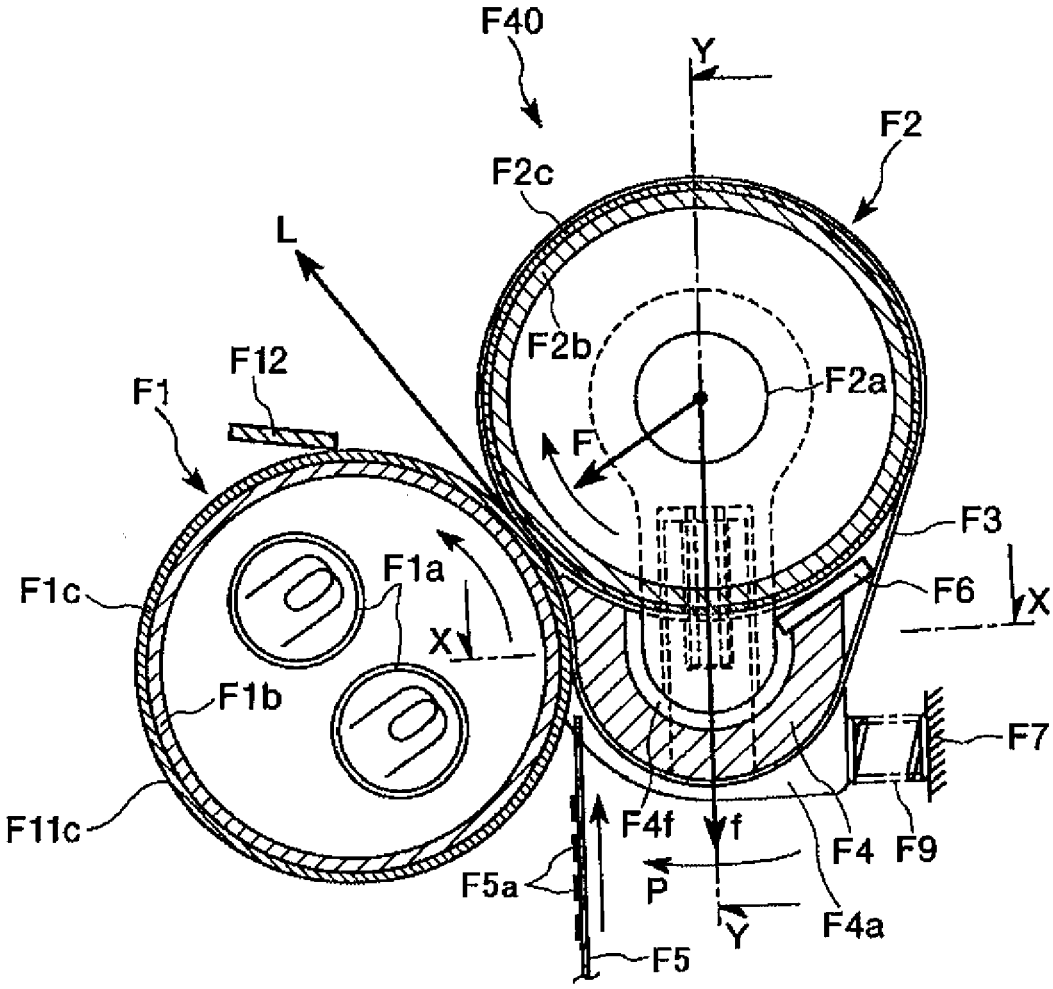
FIG. 6 is a cross-sectional view which shows one example of a fixing unit provided in the image forming apparatus shown in FIG. 1.

FIG. 1 is a schematic view which shows a first embodiment of an image forming apparatus to which the liquid developer of the present invention can be used. FIG. 2 is an enlarged view of a part of the image forming apparatus shown in FIG. 1. FIG. 3 is a schematic perspective view which shows an application roller provided in the image forming apparatus shown in FIG. 1. FIG. 4 is an enlarged schematic view of the application roller shown in FIG. 3. FIG. 5 is a schematic view which shows a state of toner particles in a layer of the liquid developer on the development roller. FIG. 6 is a cross-sectional view which shows one example of a fixing unit provided in the image forming apparatus shown in FIG. 1.

As shown in FIG. 1, the image forming apparatus 1000 includes four developing sections comprised of 30Y, 30C, 30M and 30K, a transfer section 40, and a fixing section (fixing unit) F40.

The developing sections 30Y, 30C and 30M contain respectively a yellow (Y) liquid developer, a cyan (C) liquid developer, and a magenta (M) liquid developer, and have the functions of developing latent images with the liquid developers to form monochromatic color images corresponding to the respective colors. Further, the developing section 30K contains a black (K) liquid developer, and has the function of developing a latent image with the liquid developer to form a black monochromatic image.

The developing sections 30Y, 30C, 30M and 30K have the same structure. Therefore, in the following, the developing section 30Y will be representatively described.

As shown in FIG. 2, the developing section 30Y includes a photoreceptor 10Y which carries a latent image and rotates in the direction of the arrow shown in the drawings. The image forming apparatus 1000 further includes an electrifying roller 11Y, an exposure unit 12Y, a developing unit 100Y, a photoreceptor squeeze device 101Y, a transfer backup roller 44Y, an electricity removal unit 16Y, a photoreceptor cleaning blade 17Y, and a developer collecting section 18Y, and they are arranged in the named order along the rotational direction of the photoreceptor 10Y.

The photoreceptor 10Y includes a cylindrical conductive base member and a photosensitive layer (both not shown in the drawings) formed on the outer peripheral surface of the base member, and is rotatable about the axis thereof in the clockwise direction as shown by the arrow in FIG. 1.

The liquid developer from the developing unit 100Y is supplied onto the surface of the photoreceptor 10Y so that a layer of the liquid developer is formed on the surface.

The electrifying roller 11Y is a device for uniformly electrifying the surface of the photoreceptor 10Y. The exposure unit 12Y is a device that forms an electrostatic latent image on the photoreceptor 10Y uniformly by means of laser beam irradiation.

The exposure unit 12Y includes a semiconductor laser, a polygon mirror, an F-θ lens, or the like, and irradiates a modulated laser beam onto the electrified photoreceptor 10Y in accordance with image signals received from a host computer such as a personal computer, a word processor or the like not shown in the drawings.

The developing unit 100Y is a device which develops the latent image to be visible with the liquid developer of the invention. The details of the developing unit 100Y will be described later.

The photoreceptor squeeze device 101Y is disposed so as to face the photoreceptor 10Y at the downstream side of the developing unit 100Y in the rotational direction thereof. The photoreceptor squeeze device 101Y is composed from a photoreceptor squeeze roller 13Y, a cleaning blade 14Y which is press contact with the photoreceptor squeeze roller 13Y for removing a liquid developer adhering to the surface of the photoreceptor squeeze roller 13Y, and a developer collecting section 15Y for collecting the removed liquid developer.

The photoreceptor squeeze device 101Y has a function of collecting of an excess carrier (insulation liquid) and a fog toner which is inherently unnecessary from the liquid developer developed by the photoreceptor 10Y to increase a ratio of the toner particles in the image to be formed.

The electricity removal unit 16Y is a device for removing a remnant charge on the photoreceptor 10Y after a transfer image has been transferred onto a recording medium 5F in the transfer section 40 described later.

The photoreceptor cleaning blade 17Y is a member made of rubber and provided in contact with the surface of the photoreceptor 10Y, and has a function of scrapping off the liquid developer remaining on the photoreceptor 10Y after the image has been transferred onto the recording medium 5F in the transfer section 40 described later.

The developer collecting section 18Y is provided for collecting the liquid developer removed by the photoreceptor cleaning blade 17Y.

Next, a description will be made with regard to the transfer section 40. The transfer section 40 includes a feed belt 41, a belt drive roller 42, a tension roller 43, transfer backup rollers 44Y, 44M, 44C and 44K. The feed belt 41 is composed from an endless elastic belt and has a function of feeding the recording medium F5.

The feed belt 41 is wound around the belt drive roller 42 and the tension roller 43, and the feed belt 41 is rotationally driven by the belt drive roller 42 in contact with the photoreceptors 10Y, 10M, 10C and 10K at respective positions of the transfer backup rollers 44Y, 44C, 44M and 44K.

The transfer backup roller 44Y is provided so as to be in contact with the feed belt 41 at a position that the photoreceptor 10Y is in contact with the feed belt 41. Likewise, the transfer backup roller 44M, the transfer backup roller 44C and the transfer backup roller 44K are respectively provided so as to be in contact with the feed belt 41 at each of positions that the photoreceptor 10M, the photoreceptor 10C and the photoreceptor 10K are in contact with the feed belt 41, respectively.

In such a structure, when the recording medium F5 conveyed by the feed belt 41 goes through between each of the photoreceptors 10Y, 10M, 10C and 10K and each of the transfer backup rollers 44Y, 44M, 44C and 44K, monochromic color images formed in each of the developing sections 30Y, 30M, 30C and 30K are sequentially transferred on the recording medium F5 one after another.

As described above, the image forming apparatus 1000 of the present embodiment is provided so that the monochromic color images formed by each of the developing sections 30Y, 30M, 30C and 30K are sequentially transferred onto the recording medium F5 while the recording medium F5 being conveyed to form an unfixed color image on the recording medium F5 by overlying the transferred monochromatic color images one after another in the transfer section 40.

As described above, the transfer section 40 carries the monochromatic images formed on the respective photoreceptors 10Y, 10M, 10C and 10K in a state that these images are successively secondary-transferred onto the belt so as to be overlaid one after another, and the overlaid images are transferred onto a recoding medium F5 such as paper, film and cloth as a single color image.

In the meantime, when the toner image is transferred onto the recording medium F5, there is a case that the recording medium F5 is not a flat sheet material due to fibers thereof. The elastic belt is employed as a means for increasing a secondary transfer characteristic for such a non-flat sheet material.

A toner image (transferred image) F5*a* transferred onto the recording medium F5 by the transfer section 40 is fed to a fixing unit (fixing device) F40, where the unfixed toner image is fixed onto the recoding medium F5.

Hereinbelow, a detailed description will be made with regard to the developing units 10Y, 100C, 100M and 100K. In this regard, it is to be noted that since the developing units 100Y, 100C, 100M and 100K have the same structure, in the following description the developing section 100Y will be representatively described.

As shown in FIG. 2, the developing unit 100Y includes a liquid developer storage section 31Y, an application roller 32Y, a regulating blade 33Y, a liquid developer stirring roller 34Y, a developing roller 20Y, a developing roller cleaning blade 21Y and a developer pressing roller (pressing means) 22Y.

The liquid developer storage section 31Y is provided for storing a liquid developer for developing a latent image formed on the photoreceptor 10Y. The application roller 32Y has the function of supplying the liquid developer to the developing roller 20Y.

As shown in FIG. 3, the application roller 32Y is of the type so-called as "Anilox Roller" which is constructed from a metallic roll made of iron or the like of which surface has grooves 32Ya formed regularly and helically, and a nickel plating formed on the surface.

The diameter of the roller is about 25 mm. As shown in FIG. 3, in this embodiment, a number of grooves 32Ya are formed inclinedly with respect to the rotational direction D2 by means of a cutting process or rolling process.

The application roller 32Y rotates in a clockwise direction and makes contact with the liquid developer so that the liquid developer stored in the liquid developer storage section 31Y is carried by the grooves 32Ya, and the carried liquid developer is then conveyed to the developing roller 20Y. Therefore, the application roller 32Y is capable of applying the liquid developer onto the developing roller 20Y with a portion of the roller where the grooves 32Ya are formed in the X direction of the roller.

In this regard, it is to be noted that the pitch of the grooves (that is, a periodical interval between the tips of the adjacent threads forming the grooves 32Ya in the X direction of FIG. 4) is preferably set to 55 to 250 μm depending on the necessary thickness of the layer of the liquid developer.

In this embodiment, the groove pitch P is set to be about 80 μm, the width of each thread is set to be about 40 μm, the width between the upper portions of the adjacent threads PI1 is set to be about 50 μm, the width between the lower portions of the adjacent threads PI2 is set to be about 30 μm, the depth He of each groove 32Ya is set to be about 20 μm, and the height of each thread 32Yb is set to be about 30 μm, so that a gently slanting part SL which extends from the tip of each thread to the bottom of each groove 32Ya is formed.

Further, in this embodiment, the surface roughness Rz (R1*a*) of the thread portions 32Yb is set to be nearly equal to 1.0 μm and the surface roughness Rz (R2*a*) of the groove portions 32Ya is also set to be nearly equal to 1.0 μm.

By using the application roller 32Y having such grooves described above, it becomes possible to supply the liquid developer in the liquid developer storage section 31Y to the developing roller 20Y even if there is a difference in the viscosity of each of the liquid developers.

For example, when an image forming apparatus is continued to be driven for a long period of time, there is a case that temperature raises inside the image forming apparatus and thereby the viscosity of the liquid developer is lowered. However, according to the image forming apparatus of the present invention, even in such a case, it is possible to supply a sufficient amount of the liquid developer for developing a latent image onto the developing roller 20Y stably. Therefore, it is possible to prevent or suppress generation of an uneven color image reliably in spite of the using conditions of the image forming apparatus.

As described in the above, by using the liquid developer the present invention having the effects described above is applied to the image forming apparatus 1000 provided with such an application roller 32Y, it becomes possible to make fixing property of the toner images more excellent and make no uneven color and more clear color images for the grooves.

The regulating blade 33Y is provided in contact with the surface of the application roller 32Y for regulating an amount of the liquid developer D carried on the application roller 32Y. Specifically, the regulating blade 33Y scrapes away an excess amount of the liquid developer D on the application roller 32Y so that an amount of the liquid developer D to be supplied onto the developing roller 20Y by the application roller 32Y can be regulated.

The regulating blade 33Y is formed from an elastic body made of an urethane rubber, and supported by a regulating blade supporting member made of a metal such as iron or the like. Further, the regulating blade 33Y is arranged on the side where the application roller 32Y comes out of the liquid developer D with its rotation (that is, on the left side of the vertical plane A in FIG. 2).

In this regard, it is to be noted that the rubber hardness of the regulating blade 33Y, that is, a rubber hardness (77) of a portion of the regulating blade 33Y which in press contact with the surface of the application roller 32Y is about 77 according to JIS-A.

The rubber hardness (77) of the regulating blade 33Y is lower than the rubber hardness of an elastic layer of the developing roller 20Y (described later) which is a rubber hardness (about 85) of a portion of the developing roller 20Y which is in press contact with the surface of the application roller 32Y.

The liquid developer stirring roller 34Y has a function of stirring the liquid developer so as to be homogeneously dispersed.

In the liquid developer storage section 31Y, toner particles of the liquid developer are positively charged. The liquid developer is stirred by the liquid developer stirring roller 34Y to be a homogeneously dispersed state, and such liquid developer is dipped from the liquid developer storage section 31Y according to the rotation of the application roller 32Y so that the liquid developer is supplied onto the developing roller 20Y with the amount of the liquid developer being regulated by the regulating blade 33Y.

The developing roller 20Y is provided for conveying the liquid developer to a developing position opposed to the photoreceptor 10Y in order to develop a latent image carried on the photoreceptor 10Y with the liquid developer.

The liquid developer from the application roller 32Y is supplied onto the surface of the developing roller 20Y so that a layer of the liquid developer 201Y is formed on the surface.

The developing roller 20Y includes an inner core member made of a metal such as iron or the like and an elastic layer having conductivity and provided onto an outer periphery of the inner core member. The diameter of the developing roller 20Y is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y is in press contact with both the application roller 32Y and the photoreceptor 10Y in a state that the outer layer of the developing roller 20Y is elastically deformed.

The developing roller 20Y is rotatable about its central axis, and the central axis is positioned below the central axis of the photoreceptor 10Y. Further, the developing roller 20Y rotates in a direction (clockwise direction in FIG. 2) opposite to the rotational direction (anti-clockwise direction in FIG. 2) of the photoreceptor 10Y.

It is to be noted that an electrical field is generated between the developing roller 20Y and the photoreceptor 10Y when a latent image formed on the photoreceptor 10Y is developed.

The developer pressing roller 22Y is a device having a function of pressing toner particles of the liquid developer carried by the developing roller 20Y. In other words, the developer pressing roller 22Y is a device that applies an electrical field of the same polarity as the toner particle 1 to the liquid developer layer 201Y described above to thereby unevenly distribute the toner particles at the vicinity of the developing roller 20Y in the liquid developer layer 201Y as shown in FIG. 5.

By unevenly distributing the toner particles in this way, it is possible to improve an image density (developing efficiency), and as a result it becomes possible to obtain a high quality clear image.

The developer pressing roller 22Y is provided with a cleaning blade 23Y. The cleaning blade 23Y has a function of removing a liquid developer adhering to the developer pressing roller 22Y.

The developing unit 100Y has a developing roller cleaning blade 21Y made of rubber and provided in contact with the surface of the developing roller 20Y. The developing roller cleaning blade 21Y is a device for scrapping off the liquid developer remaining on the developing roller 20Y after the development of an image has been carried out at the developing position. The liquid developer removed by the developing roller cleaning blade 21Y is collected in the liquid developer storage section 31Y and reused.

Further, the image forming apparatus 1000 has a reuse device for reusing an insulation liquid in the liquid developer collected in the respective developer collecting sections (15Y, 18Y).

The reuse device includes a feed line 70 which feeds the liquid developer collected in the respective developer collecting sections, and a filter means 77 for removing a solid matter (toner particles and the like) contained in the liquid developer, and an insulation liquid storage section 74 for storing an insulation liquid from which a solid matter has been removed by the filter means 77.

In the feed line 70, a pump 76 is provided, and by using the pump 76, the liquid developer collected in the respective developer collecting sections is fed to the insulation liquid storage section 74.

The insulation liquid stored in the insulation liquid storage section 74 is fed to the respective developing sections appropriately with a feeding means not shown in the drawing for reuse.

Further, the solid matter removed by the filter means 77 is detected by a detecting means for detecting a state of the filter means (not shown in the drawing). Base on the detected result, the filter means 77 can be replaced. This makes it possible to maintain the filtering function of the filter means 77 stably.

Next, a description will be made with regard to a fixing section F40.

The fixing unit (fixing section) F40 is provided for fixing unfixed toner images F5*a* formed on the developing section P2 and the transfer section 18 onto a recording medium F5.

As shown in the FIG. 6, the fixing unit (fixing section) F40 is generally composed from a heat fixing roller F1, a pressure roller F2, a heat resistant belt F3, a belt tension member F4, a cleaning member F6, a frame F7 and a spring F9.

The heat fixing roller (hereinafter, simply referred to as "fixing roller") F1 has a roller base F1*b* formed from a pipe member, an elastic body F1*c* which covers the outer periphery of the roller base F1*b*, and a pair of halogen lamps F1*a* provided inside the roller base F1. Each of the halogen lamps F1*a* has a columnar shape and acts as a heat source. The heat fixing roller F1 having the above structure is rotatable in an anti-clockwise direction shown by the arrow in the drawing.

On the outer surface of the elastic body F1*c* of the heat fixing roller F1, there is formed a PFA layer. By composing the heat fixing roller F1 and the pressure roller F2 as mentioned above, even if the thickness of the elastic body F1*c* of the heat fixing roller F1 is different from the thickness of the elastic body F2*c* of the pressure roller F2, the elastic body F1*c* and the elastic body F2*c* are subjected to substantially uniform elastic deformation to form a so-called horizontal nip.

Further, since there is no difference between a circumferential velocity of the heat fixing roller F1 and a conveying speed of a heat resistant belt F3 described below or a recording medium F5, it is possible to fix an image in an extremely stable manner.

Further, as described above, inside the heat fixing roller F1, two halogen lamps F1*a*, F1*a* each having a columnar shape and acting as a heat source are provided. These halogen lamps F1*a*, F1*a* are provided with heating elements, respectively, which are arranged at different positions.

With this arrangement, by selectively lighting up any one or both of the halogen lamps F1*a*, F1*a*, it is possible to easily carry out a temperature control under different conditions such as a case where a wide recording medium is used or a narrow recording medium is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The pressure roller F2 is arranged so as to face the heat fixing roller F1 so that a pressing pressure is applied against the recording medium F5 on which an unfixed toner image F5*a* is formed through a heat resistant belt F3.

Further, as described above, the pressure roller F2 has a roller base F2*b* formed from a pipe member and an elastic body F2*c* which covers the outer periphery of the roller base F2*b*. The pressure roller F2 is rotatable in a clockwise direction shown by the arrow in the drawing.

The elastic body F1*c* of the heat fixing roller F1 and the elastic body F2*c* of the pressure roller F2 are subjected to substantially uniform elastic deformation to form a so-called horizontal nip. Further, since there is no difference between a circumferential velocity of the heat fixing roller F1 and a conveying speed of a heat resistant belt F3 described below or a recording medium F5, it is possible to fix an image in an extremely stable manner.

The heat resistant belt F3 is a ring-shaped endless belt, and it is would around the outer circumferences of the pressure roller F2 and the belt tension member F4 so that it can be moved with being held between the heat fixing roller F1 and the pressure roller F2 in a pressed state.

The heat resistant belt F3 is formed from a seamless tube having a thickness of 0.03 mm or more. Further, the seamless tube has a two layered structure in which its surface (which is the surface thereof that makes contact with the recording medium F5) is formed of PFA, and the opposite surface thereof (that is, the surface thereof that makes contact with the pressure roller F2 and the belt tension member F4) is formed of polyimide.

However, the structure of the heat resistant belt F3 is not limited to the structure described above, and it may be formed from other materials. Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the recording medium F5 conveying direction. Further, the belt tension member F4 is pivotally disposed about the rotation shaft F2*a* of the pressure roller F2 so as to be movable along the arrow P.

The belt tension member F4 is constructed so that the heat resistant belt F3 is extended with tension in the tangential direction of the heat fixing roller F1 in a state that the recording medium F5 does not pass through the fixing nip part. When the fixing pressure is large at an initial position where the recording medium F5 enters the fixing nip part, there is a case that the recording medium F5 can not enter the fixing nip part smoothly and thereby fixation is performed in a state that a tip part of the recording medium F5 is folded.

However, in this embodiment, the belt tension member F4 is provided so that the heat resistant belt F3 is extended with tension in the tangential direction of the heat fixing roller F1 as described above, there is formed an introducing portion for smoothly introducing the recording medium F5, so that the recording medium F5 can be introduced into the fixing nip part in a stable manner.

The belt tension member F4 is a roughly semi-circular member for slidably guiding the heat resistant belt F3 (that is, the heat resistant belt F3 slidably moves on the belt tension member F4). The belt tension member F4 is fitted into the inside of the heat resistant belt F3 so as to impart tension f to the heat resistant belt F3 in cooperation with the pressure roller F2.

The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2.

The protruding wall F4*a* is formed on any one or both of the end surfaces of the belt tension member F4 which are located in the axial direction thereof. The protruding wall F4*a* is provided for restricting the heat resistant belt F3 from being off to the side by abutment thereto in a case that the heat resistant belt F3 is deviated in any one of the sides.

Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roller F1 in slidably contact with the heat fixing roller F1.

A position where the belt tension member F4 is slightly pressed against the heat fixing roller F1 is set as a nip starting position and a position where the pressure roller F2 is pressed against the heat fixing roller F1 is set as a nip ending position.

In the fixing unit F40, a recording medium F5 on which an unfixed toner image F5*a* is formed using the above liquid developing unit enters into the fixing nip part from the nip starting position, then passes between the heat resistant belt F3 and the heat fixing roller F1, and then exits from the nip ending position, and in this way an unfixed toner image F5*a* formed on the recording medium F5 is fixed.

Thereafter, the recording medium 2 on which the toner image is formed is fed out toward the tangential direction L of the pressing potion of the press roller F2 against the heat fixing roller F1.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3.

By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

Further, the fixing unit F40 is provided with a removal blade (removal means) F12 for removing an insulation liquid adhering to or remaining on the surface of the heat fixing roller F1 after the toner image F5*a* has been fixed onto the recording medium F5. The insulation liquid removal blade F12 can not only remove the insulation liquid but also remove a toner or the like which has been transferred onto the heat fixing roller F1 at the same time upon fixation.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3.

However, there is a case that these frictional coefficients become unstable due to entering of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2.

With this structure, the distance that the heat resistant belt F3 moves on the belt tension member F4 becomes short so that unstable factors due to deterioration with the elapse of time and disturbance can be avoided or reduced. As a result, it is possible to drive the heat resistant belt F3 with the pressure roller F2 in a stable manner.

A fixing temperature which is applied to the toner images by the heat fixing roller F1 is preferably in the range of 80 to 200° C., and more preferably in the range of 100 to 180° C.

Second Embodiment of Image Forming Apparatus

Next, a description will be made with regard to a second embodiment of an image forming apparatus of the present invention.

Figure 7:
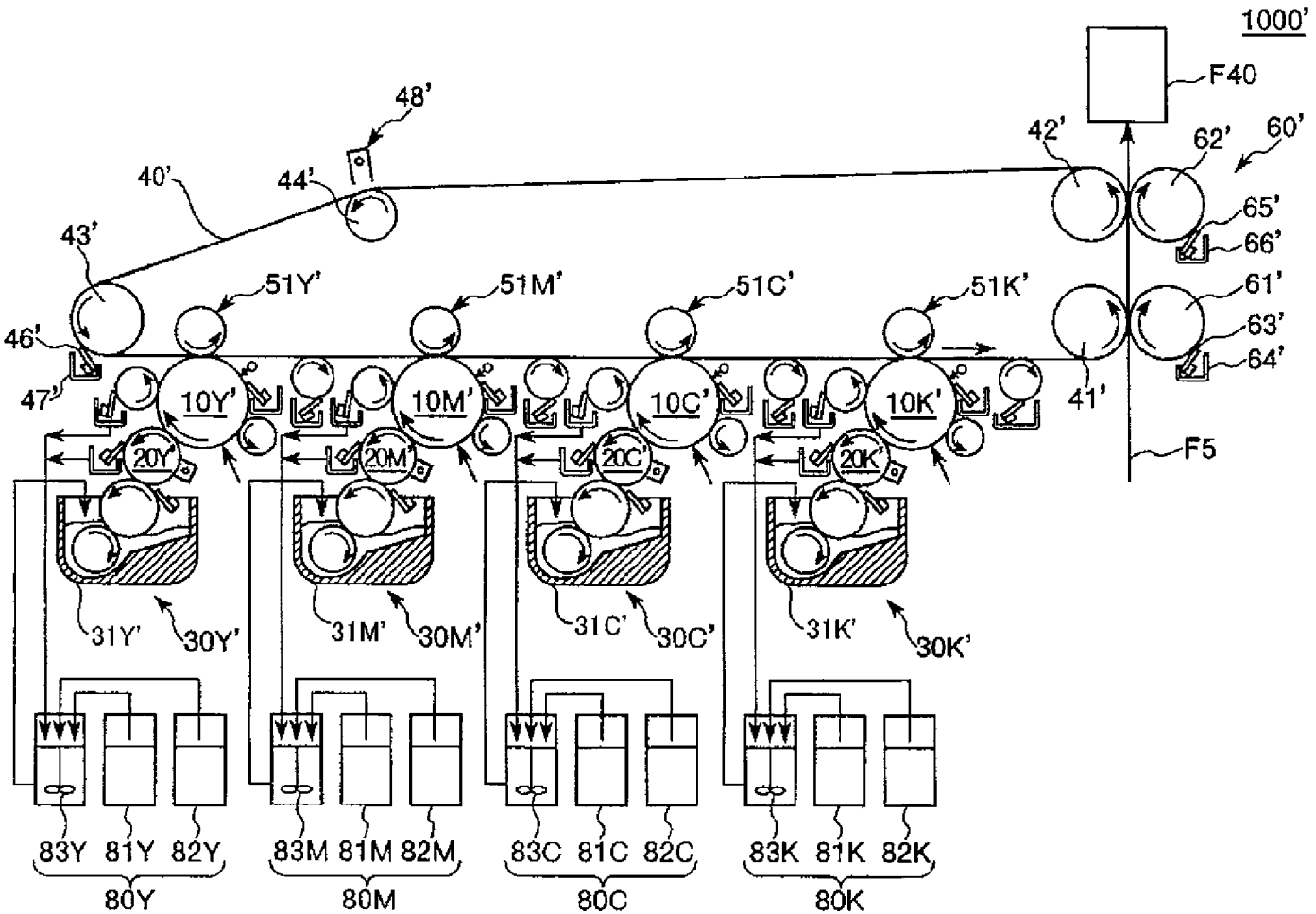
FIG. 7 is a schematic view which shows a second embodiment of an image forming apparatus to which the liquid developer of the present invention can be used.
Figure 8:
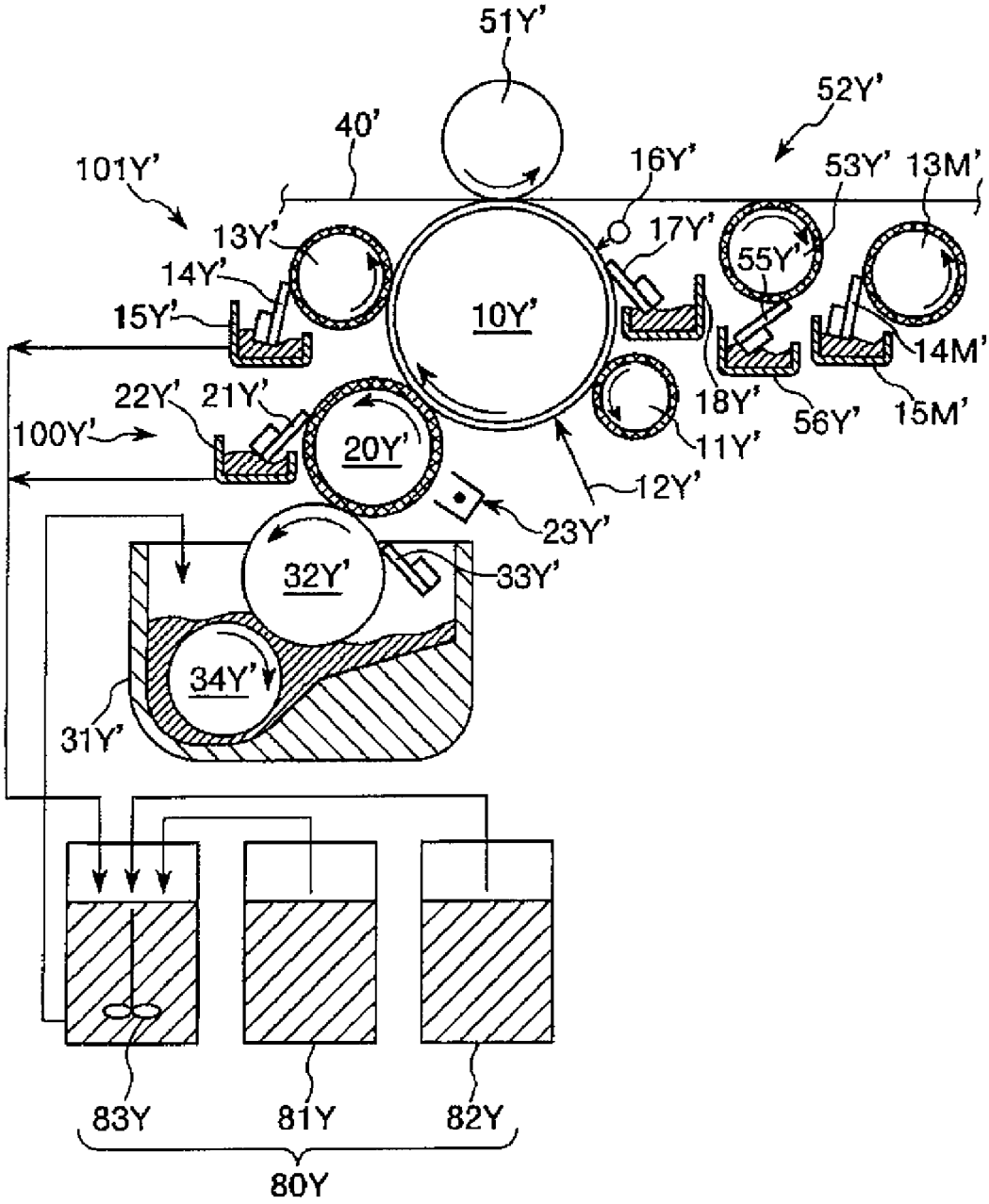
FIG. 8 is an enlarged view of a part of the image forming apparatus shown in FIG. 7.

FIG. 7 is a schematic view which shows a second embodiment of an image forming apparatus to which the liquid developer of the present invention can be used. FIG. 8 is an enlarged view of a part of the image forming apparatus shown in FIG. 7.

As shown in FIG. 7 and FIG. 8, the image forming apparatus 1000' includes four developing sections comprised of 30Y', 30C', 30M' and 30K', an intermediate transfer section 40', a secondary transfer unit (secondary transfer section) 60', a fixing section (fixing unit) F40 used in the first embodiment of the image forming apparatus and four liquid developer supply sections 80Y, 80M, 80C and 80K.

The developing sections 30Y', 30C' and 30M' contain respectively a yellow (Y) liquid developer, a cyan (C) liquid developer, and a magenta (M) liquid developer, and have the functions of developing latent images with the liquid developers to form monochromatic color images corresponding to the respective colors. Further, the developing section 30K' contains a black (K) liquid developer, and has the function of developing a latent image with the liquid developer to form a black monochromatic image.

The developing sections 30Y', 30C', 30M' and 30K' have the same structure. Therefore, in the following, the developing section 30Y' will be representatively described.

As shown in FIG. 8, the developing section 30Y' includes a photoreceptor 10Y' which carries a latent image and rotates in the direction of the arrow shown in the drawings. The image forming apparatus 1000' further includes an electrifying roller 11Y', an exposure unit 12Y', a developing unit 100Y', a photoreceptor squeeze device 101Y', a primary transfer backup roller 51Y', an electricity removal unit 16Y', a photoreceptor cleaning blade 17Y', and a developer collecting section 18Y', and they are arranged in the named order along the rotational direction of the photoreceptor 10Y'.

The photoreceptor 10Y' includes a cylindrical conductive base member and a photosensitive layer (both not shown in the drawings) which is constituted of a material such as amorphous silicon or the like formed on the outer peripheral surface of the base member, and is rotatable about the axis thereof in the clockwise direction as shown by the arrow in FIG. 8.

The liquid developer is supplied onto the surface of the photoreceptor 10Y' from the developing unit 10Y' so that a layer of the liquid developer is formed on the surface.

The electrifying roller 11Y' is a device for uniformly electrifying the surface of the photoreceptor 10Y'. The exposure unit 12Y' is a device that forms an electrostatic latent image on the photoreceptor 10Y' uniformly by means of laser beam irradiation.

The exposure unit 12Y' includes a semiconductor laser, a polygon mirror, an F-θ lens, or the like, and irradiates a modulated laser beam onto the electrified photoreceptor 10Y' in accordance with image signals received from a host computer such as a personal computer, a word processor or the like not shown in the drawings.

The developing unit 100Y' is a device which develops the latent image to be visible with the liquid developer of the invention. The details of the developing unit 100Y' will be described later.

The photoreceptor squeeze device 101Y' is disposed so as to face the photoreceptor 10Y' at the downstream side of the developing unit 100Y' in the rotational direction thereof. The photoreceptor squeeze device 101Y' is composed from a photoreceptor squeeze roller 13Y', a cleaning blade 14Y' which is press contact with the photoreceptor squeeze roller 13Y' for removing a liquid developer adhering to the surface of the photoreceptor squeeze roller 13Y', and a developer collecting section 15Y' for collecting the removed liquid developer.

The photoreceptor squeeze device 101Y' has a function of collecting of an excess carrier (insulation liquid) and a fog toner which is inherently unnecessary from the liquid developer developed by the photoreceptor 10Y' to increase a ratio of the toner particles in the image to be formed.

The primary transfer backup roller 51Y' is a device for transferring a monochrome toner image formed on the photoreceptor 10Y' to the intermediate transfer section (belt) 40'.

The electricity removal unit 16Y' is a device for removing a remnant charge on the photoreceptor 10Y' after an intermediate image has been transferred to the intermediate transfer section 40' by the primary transfer backup roller 51Y'.

The photoreceptor cleaning blade 17Y' is a member made of rubber and provided in contact with the surface of the photoreceptor 10Y', and has a function of scrapping off the liquid developer remaining on the photoreceptor 10Y' after the image has been transferred onto the intermediate transfer section 40' by the primary transfer backup roller 51Y'.

The developer collecting section 18Y' is provided for collecting the liquid developer removed by the photoreceptor cleaning blade 17Y'.

The intermediate transfer section 40' is composed from an endless elastic belt which is wound around a belt drive roller 41' to which driving force is transmitted by a motor not shown in the drawings, a pair of driven rollers 42' and 43', and a tension roller 44. The intermediate transfer section 40' is rotationally driven in the anticlockwise direction by the belt drive roller 41' while being in contact with the photoreceptors 10Y', 10M', 10C' and 10K' at each of positions that the primary transfer backup rollers 51Y', 51C', 51M' and 51K' are in contact with an intermediate transfer belt (feed belt).

The intermediate transfer section 40' is constructed so that a predetermined tension is given by the tension roller 44' to prevent loosening of the endless elastic belt. The tension roller 44' is disposed at the downstream side of the intermediate transfer section 40' in the moving direction thereof with respect to one driven roller 42' and at the upstream side of the intermediate transfer section 40' in the moving direction thereof with respect to the other driven roller 43'.

Monochromatic images corresponding to the respective colors formed by the developing sections 30Y', 30C', 30M' and 30K' are sequentially transferred by the primary transfer backup rollers 51Y', 51C', 51M' and 51K' so that the monochromatic images corresponding to the respective colors are overlaid, thereby enabling a full color toner image (intermediate transferred image) to be formed on the intermediate transfer section 40' which will be described later.

The intermediate transfer section 40' carries the monochromatic images formed on the respective photoreceptors 10Y', 10M', 10C' and 10K' in a state that these images are successively secondary-transferred onto the belt so as to be overlaid one after another, and the overlaid images are transferred onto a recoding medium F5 such as paper, film and cloth as a single color image in the secondary transfer unit 60' described later.

In the meantime, when the toner image is transferred onto the recording medium F5 in the secondary transfer process, there is a case that the recording medium F5 is not a flat sheet material due to fibers thereof. The elastic belt is employed as a means for increasing a secondary transfer characteristic for such a non-flat sheet material.

Further, the intermediate transfer section 40' is also provided with a cleaning device which is composed form an intermediate transfer section cleaning blade 46', a developer collecting section 47' and a non-contact type bias applying member 48'. The intermediate transfer section cleaning blade 46' and the developer collecting section 47' are arranged on the side of the driven roller 43'.

The intermediate transfer section cleaning blade 46' has a function of scrapping off of the liquid developer adhering to the intermediate transfer section 40' to remove it after the image has been transferred onto a recording medium F5 by the secondary transfer unit (secondary transfer section) 60'.

The developer collecting section 47' is provided for collecting the liquid developer removed by the intermediate transfer section cleaning blade 46'.

The non-contact type bias applying member 48' is disposed so as to be apart from the intermediate transfer section 40' at an opposite position of the tension roller 44' through the intermediate transfer section (that is, elastic belt) 40'.

The non-contact type bias applying member 48' applies a bias voltage having a reversed polarity with respect to a polarity of the toner particles to each of the toner particles (solid content) contained in the liquid developer remaining on the intermediate transfer section 40' after the image has been secondary-transferred onto the recording medium 5F. This makes it possible to remove electricity from the remaining toner particles so that it is possible to lower electrostatic adhesion force of the toner particles to the intermediate transfer section 40'. In this embodiment, a corona electrification device is used as the non-contact type bias applying member 48'.

In this regard, it is to be noted that the non-contact type bias applying member 48' may not be necessarily disposed at the opposite position of the tension roller 44' through the intermediate transfer section (that is, elastic belt) 40'.

For example, the non-contact type bias applying member 48' may be disposed at any position between the downstream side of the intermediate transfer section 40' in the moving direction thereof with respect to one driven roller 42' and the upstream side of the intermediate transfer section 40' in the moving direction thereof with respect to the other driven roller 43' such as any position between the driven roller 42' and the tension roller 44'.

Note that as the non-contact type bias applying member 48', various known non-contact type electrification devices other than the corona electrification device may be employed.

An intermediate transfer second squeeze device 52Y' is provided at the downstream side of the primary transfer backup roller 51Y' in the moving direction of the intermediate transfer section 40' (see FIG. 8).

The intermediate transfer squeeze device 52Y' is provided as a means for removing an excess amount of the insulation liquid from the transferred liquid developer in the case where the liquid developer transferred onto the intermediate transfer section 40' does not have a desired dispersion state.

As shown in FIG. 8, the intermediate transfer squeeze device 52Y' includes an intermediate transfer squeeze roller 53Y', an intermediate transfer squeeze roller cleaning blade 55Y' which is in press contact with the intermediate transfer squeeze roller 53Y' for cleaning the surface thereof, and a liquid developer collecting section 56Y' which collects the liquid developer removed from the intermediate transfer squeeze roller 53Y' by the intermediate transfer squeeze roller cleaning blade 55Y'.

The intermediate transfer squeeze device 52Y' has a function of collecting an excess carrier from the liquid developer primary-transferred to the intermediate transfer section 40' to increase a ratio of the toner particles in an image to be formed and collecting a fog toner which is inherently unnecessary.

The secondary transfer unit 60' is provided a pair of secondary transfer rollers 61' and 62' which are arranged so as to depart from a predetermined distance each other along in the moving direction of the recording medium F5. Among a pair of the secondary transfer rollers 61' and 62', the upstream side secondary transfer roller 61' is arranged upstream side of the intermediate transfer section 40' in the rotational direction thereof. This upstream side secondary transfer roller 61' is capable of press contact with the belt drive roller 41' through the intermediate transfer section 40'.

Among a pair of the secondary transfer rollers 61' and 62', the downstream side secondary transfer roller 62' is arranged at a downstream side of a recording medium F5 in the moving direction thereof. This downstream side secondary transfer roller 62' is capable of press contact to the recording medium F5 with the driven roller 42' through the intermediate transfer section 40'.

Namely, intermediate transfer images which are formed on the intermediate transfer section 40' by overlaying the transferred monochromatic color images in state that the recording medium F5 is in contact with the intermediate transfer section 40' which wound around the belt drive roller 41' and the driven roller 42' and goes through between the driven roller 42' and the downstream side secondary transfer roller 62' and between the belt driven roller 41' and the upstream side secondary transfer roller 61' are secondary-transferred on the recording medium F5.

In this case, the belt driven roller 41' and the driven roller 42' have a function as the upstream side secondary transfer roller 61' and the downstream side secondary transfer roller 62', respectively.

Namely, the belt driven roller 41' is also used as an upstream side backup roller arranged at the upstream side of the recording medium F5 to the driven roller 42' in the moving direction thereof in the secondary transfer unit 60'.

The driven roller 42' is also used as a downstream side backup roller arranged in the downstream side of the recording medium F5 to the belt driven roller 41' in the moving direction thereof in the secondary transfer unit 60'.

The recording medium F5 which have conveyed to the secondary transfer unit 60' is allowed to adhere to the intermediate transfer belt at positions between the upstream side secondary transfer roller 61' and the belt driven roller 41' (nip starting position) and between the downstream side secondary transfer roller 62' and the driven roller 42' (nip ending position).

Since this make it possible to second-transfer the intermediate transfer images of a full color on the intermediate transfer section 40' to the recording medium F5 with adhesion to the intermediate transfer section 40' for a predetermined period of time, it is possible to second-transfer the intermediate images reliably.

The secondary transfer unit 60' is provided a secondary transfer roller cleaning blade 63' and a developer collecting section 64' with respect to the secondary transfer roller 61'. The secondary transfer unit 60' is also provided a secondary transfer roller cleaning blade 65' and a developer collecting section 66' with respect to the secondary transfer roller 62'.

Each of the secondary transfer roller cleaning blades 63' and 65' is in contact with the respective secondary transfer rollers 61' and 62' to secondary-transfer. After the second-transfer, the liquid developer remaining on the surfaces of each of the secondary transfer rollers 61' and 62' is scrapped off by the secondary transfer roller cleaning blades 63' and 65' and removed from the secondary transfer rollers 61' and 62'.

The liquid developer scrapped off the surfaces of each of the respective secondary transfer rollers 61' and 62' by each of the secondary transfer roller cleaning blades 63' and 65' is collected and preserved by each of the developer collecting sections 64' and 66'.

A toner image (transferred image) F5*a* transferred onto the recording medium F5 by the secondary transfer section 60' is fed to a fixing unit (fixing device) F40 (which will be described later), where the unfixed toner image is fixed onto the recoding medium F5.

Hereinbelow, a detailed description will be made with regard to the developing units 100Y', 100C', 100M' and 100K'. In this regard, it is to be noted that since the developing units 100Y', 100C', 100M' and 100K' have the same structure, in the following description the developing section 100Y' will be representatively described.

As shown in FIG. 8, the developing unit 100Y' includes a liquid developer storage section 31Y', an application roller 32Y', a regulating blade 33Y', a liquid developer stirring roller 34Y', a developing roller 20Y', a developing roller cleaning blade 21Y' and a corona electrification device (pressing means) 23Y'.

The liquid developer storage section 31Y' is provided for storing a liquid developer for developing a latent image formed on the photoreceptor 10Y'. The application roller 32Y' has the function of supplying the liquid developer to the developing roller 20Y'.

As shown in FIG. 8, the application roller 32Y' is of the type so-called as "Anilox Roller" which is constructed from a metallic roll made of iron or the like of which surface has grooves formed regularly and helically, and a nickel plating formed on the surface.

The diameter of the roller is about 25 mm. As described above embodiment, in this embodiment, a number of grooves 32Y' are formed inclinedly with respect to the rotational direction D2 by means of a cutting process or rolling process.

The application roller 32Y' rotates in an anti-clockwise direction and makes contact with the liquid developer so that the liquid developer stored in the liquid developer storage section 31Y' is carried by the grooves, and the carried liquid developer is then conveyed to the developing roller 20Y'.

The regulating blade 33Y' is provided in contact with the surface of the application roller 32Y' for regulating an amount of the liquid developer carried on the application roller 32Y'. Specifically, the regulating blade 33Y' scrapes away an excess amount of the liquid developer on the application roller 32Y' so that an amount of the liquid developer to be supplied onto the developing roller 20Y' by the application roller 32Y' can be regulated.

The regulating blade 33Y' is formed from an elastic body made of an urethane rubber, and supported by a regulating blade supporting member made of a metal such as iron or the like. Further, the regulating blade 33Y' is arranged on the side where the application roller 32Y' comes out of the liquid developer with its rotation (that is, on the left side in FIG. 8).

In this regard, it is to be noted that the rubber hardness of the regulating blade 33Y', that is, a rubber hardness (77) of a portion of the regulating blade 33Y' which in press contact with the surface of the application roller 32Y' is about 77 according to JIS-A.

The rubber hardness (77) of the regulating blade 33Y' is lower than the rubber hardness of an elastic layer of the developing roller 20Y' (described later) which is a rubber hardness (about 85) of a portion of the developing roller 20Y' which is in press contact with the surface of the application roller 32Y'.

Further, an excess amount of the liquid developer scraped off by the regulating blade 33Y' is collected in the liquid developer storage section 31Y' and it is then reused.

The liquid developer stirring roller 34Y' has a function of stirring the liquid developer so as to be homogeneously dispersed. By providing such a liquid developer stirring roller 34Y', even when a plurality of toner particle 1 are aggregated in the liquid developer storage section 31Y', it is possible to disperse the plurality of toner particle 1 reliably. Especially, even when the liquid developer used once is reused, it is possible to disperse the plurality of toner particle 1 reliably.

In the liquid developer storage section 31Y', the plurality of toner particle 1 of the liquid developer are positively charged. The liquid developer is stirred by the liquid developer stirring roller 34Y' to be a homogeneously dispersed state, and such a liquid developer is dipped from the liquid developer storage section 31Y' according to the rotation of the application roller 32Y' so that the liquid developer is supplied onto the developing roller 20Y' with the amount of the liquid developer being regulated by the regulating blade 33Y'.

The developing roller 20Y' is provided for conveying the liquid developer to a developing position opposed to the photoreceptor 10Y' in order to develop a latent image carried on the photoreceptor 10Y' with the liquid developer.

The liquid developer from the application roller 32Y' is supplied onto the surface of the developing roller 20Y' so that a layer of the liquid developer 201Y' is formed on the surface.

The developing roller 20Y' includes an inner core member made of a metal such as iron or the like and an elastic layer having conductivity and provided onto an outer periphery of the inner core member. The diameter of the developing roller 20Y' is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y' is in press contact with both the application roller 32Y' and the photoreceptor 10Y' in a state that the outer layer of the developing roller 20Y' is elastically deformed.

The developing roller 20Y' is rotatable about its central axis, and the central axis is positioned below the central axis of the photoreceptor 10Y'. Further, the developing roller 20Y' rotates in a direction (clockwise direction in FIG. 8) opposite to the rotational direction (anti-clockwise direction in FIG. 8) of the photoreceptor 10Y'.

It is to be noted that an electrical field is generated between the developing roller 20Y' and the photoreceptor 10' when a latent image formed on the photoreceptor 10Y', is developed.

The corona electrification device (pressing means) 23Y' is a device having a function of pressing toner particles of the liquid developer carried by the developing roller 20Y'. In other words, the corona electrification device 23Y' is a device that applies an electrical field of the same polarity as a toner particle 1 to the liquid developer layer 201Y' described above to thereby unevenly distribute the toner particles at the vicinity of the developing roller 20Y' in the liquid developer layer 201Y' as shown in FIG. 5.

By unevenly distributing the toner particles in this way, it is possible to improve an image density (developing efficiency), and as a result it becomes possible to obtain a high quality clear image.

In this regard, it is to be noted that the application roller 32Y' is driven by a power source (not shown) which is difference from a power source for driving the developing roller 20Y'. Therefore, by changing a rotational speed (linear velocity) ratio of each of the application roller 32Y' and the developing roller 20Y', it is possible to adjust an amount of the liquid developer to be supplied onto the developing roller 20Y'.

The developing unit 100Y' has a developing roller cleaning blade 21Y' made of rubber and provided in contact with the surface of the developing roller 20Y' and a developer collecting section 22Y'. The developing roller cleaning blade 21Y' is a device for scrapping off the liquid developer remaining on the developing roller 20Y' after the development of an image has been carried out at the developing position. The liquid developer removed by the developing roller cleaning blade 21Y' is collected in the developer collecting section 22Y'.

As shown in FIG. 7 and FIG. 8, the image forming apparatus 1000' is provided with liquid developer supply sections 80Y, 80M, 80C and 80K which supply the liquid developers to the developing sections 30Y', 30M', 30C' and 30K', respectively.

The liquid developer supply sections 80Y, 80M, 80C and 80K have the same structure, respectively. Namely, the liquid developer supply sections 80Y, 80M, 80C and 80K are provided with liquid developer tanks 81Y, 81M, 81C and 81K, insulation liquid tanks 82Y, 82M, 82C and 82K and stirring devices 83Y, 83M, 83C and 83K, respectively.

In each of the liquid developer tanks 81Y, 81M, 81C and 81Y, a liquid developer of high concentration which corresponds to each of the different colors is stored. Further, in each of the insulation liquid tanks 82Y, 82M, 82C and 82K, the insulation liquid is stored.

Further, each of the stirring devices 83Y, 83M, 83C and 83K is constructed so that a predetermined amount of the high concentration liquid developer is supplied from each of the corresponding liquid developer tanks 81Y, 81M, 81C and 81Y and a predetermined amount of the insulation liquid is supplied from each of the corresponding insulation liquid tanks 82Y, 82M, 82C and 82K.

In each of the stirring devices 83Y, 83M, 83C and 83K, the supplied high concentration liquid developer and the supplied insulation liquid are mixed with being stirred to prepare the liquid developers corresponding to different colors which are to be used in the developing sections 31Y', 31M', 31C' and 31K', respectively. The liquid developers prepared in the respective stirring devices 83Y, 83M, 83C and 83K in this way are supplied to the corresponding liquid developer storage sections 31Y', 31M', 31C' and 31K', respectively.

As shown in FIG. 7 and FIG. 8, the liquid developers collected in the respective developer collecting sections 15Y', 15M', 15C' and 15K' and the liquid developers collected in the respective developer collecting sections 22Y', 22M', 22C' and 22K' are respectively collected to the stirring devices 83Y, 83M, 83C and 83K and then they are reused.

In this regard, it is to be noted that a description of the fixing section F40 is omitted since it has the same structure as that in the first embodiment of the image forming apparatus described above.

In the foregoing, the invention was described based on the preferred embodiments, but the invention is not limited to these embodiments.

For example, the liquid developer of the present invention is not limited to one that is to be used in the image forming apparatuses as described above.

Further, the liquid developer of the present invention is not limited to one produced by the method described above.

Further, in the above described embodiments, an electrolyte is added to the water-based emulsion obtained by adding the resin solution to the aqueous solution so that the particles of the dispersoid are associated to thereby form associated particles. But the present invention is not limited thereto.

For example, a coloring agent, a monomer of a polyester resin, a surfactant and a polymerization initiator are dispersed in the water-based liquid, and a water-based emulsion is prepared by an emulsion polymerization, and then an electrolyte is added to the water-based emulsion, so that the particles of the dispersoid are associated to thereby form associated particles (this method is called as "emulsion polymerization association method"). Further, the obtained water-based emulsion is dried by a spry to thereby obtain associated particles.

EXAMPLES

1 Production of Liquid Developer

Example 1

Preparation of Fatty Acid Monoester

A fatty acid monoester solution constituting an insulation liquid was prepared as follows.

First, a crude soy oil was refined as follows to obtain a finely refined soy oil. The crude soy oil was roughly refined by a low temperature crystallization method using methanol, diethylether, petroleum ether, acetone, or the like as a solvent to be used for the roughly refined.

Next, 300 parts by volume of the obtained roughly refined soy oil (first roughly refined oil) was put into a flask. And then 100 parts by volume of boiled water was poured into the flask, and thereafter the flask was closed with a plug or cap.

Next, the flask was shaken, and the roughly refined soy oil (first roughly refined oil) was mixed with the boiled water to obtain a mixture.

Next, the flask was left at rest until the mixture in the flask was separated into three layers. After the complete separation to the three layers was confirmed, the flask containing the mixture therein was placed in a refrigerator and refrigerated for 24 hours.

Thereafter, the flask was get out of the refrigerator to transfer an unfrozen component (other than the water) to another flask. With regard to the unfrozen component, the same operations as those described above were repeatedly carried out again to take out an unfrozen component to thereby obtain a roughly refined soy oil (second roughly refined oil).

Next, 100 parts by volume of the thus obtained second roughly refined oil was mixed with 35 parts by volume of an activated clay mainly constituted of aluminum silicate containing water in a flask and it was stirred to thereby obtain a mixture.

Next, the thus obtained mixture was preserved under the pressure (0.18 MPa) for 48 hours. At that time, the activated clay was completely precipitated.

Thereafter, the precipitate was removed to obtain finely refined soy oil (hereinbelow, simply referred to as "soy oil"). In this regard, it is to be noted that a fatty acid glyceride mainly constituted of a linolic acid component was contained in the soy oil.

Further, it is to be noted that an amount of an unsaturated fatty acid glyceride contained in the soy oil was 98 wt % and an amount of the linolic acid component of the fatty acid glyceride with respect to a total amount of the fatty acid was 53 mol %.

Next, the thus obtained soy oil was subjected to an ester-exchange reaction with methanol, and glycerine produced by the reaction was removed to thereby obtain a solution mainly constituted of fatty acid monoester.

Next, the solution mainly constituted of the fatty acid monoester was further refined to thereby obtain a soy oil-fatty acid methyl containing the fatty acid monoester of 99.9 wt % or higher. The thus obtained fatty acid monoester contained an unsaturated fatty acid monoester such as methyl oleate, methyl linoleate, methyl α-linolenate, and the like and a saturated fatty acid monoester such as methyl palmitate, methyl stearate, and the like. An amount of the unsaturated fatty acid monoester contained in the fatty acid monoester was 84%.

Further, a viscosity of the soy oil-fatty acid methyl measured according to JIS Z8809 using a vibration type viscometer at a temperature of 25° C. was 3.0 mPa·s.

Preparation of Coloring Agent Master Solution

First, a polyester resin (softening point $T_f$ thereof was 99° C.) and a cyan type pigment ("Pigment Blue 15:3", produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder having an average particle size of 1.0 mm or less.

Methylethylketone was added to the powder of the kneaded material obtained so that an amount of the powder of the kneaded material (polyester resin and pigment) became 30 wt % and then the mixture was subjected to a wet dispersion process with an aigar motor mill ("M-1000" produced by American Aigar Co., Ltd.) to prepare a coloring agent master solution.

Preparation of Resin Solution 200 parts by weight of methylethylketone and 73 parts by weight of the polyester resin were added into 33 parts by weight of the coloring agent master solution to obtain a mixture and then the mixture was stirred with an aigar motor mill ("M-1000" produced by American Aigar Co., Ltd.) to obtain a resin solution. In the resin solution, the pigment was finely dispersed homogeneously.

Preparation of Water-Based Emulsion 500 parts by weight of the resin solution and 45.5 parts by weight of methylethylketone were put into a cylindrical separable flask of 2 L having a maxblend stirring blade. It is to be noted that an amount of a solid content, namely, the pigment and the polyester resin derived from the coloring agent master solution and the polyester derived from the resin solution contained in the resin solution was 55 wt %.

Next, 41.7 parts by weight of 1N ammonia water (a mol equivalent ratio of ammonia and a total amount of carboxyl groups that the polyester resin had in a molecular structure thereof was 1.1) was added to the resin solution in the separable flask to obtain a mixture. Then, the mixture was sufficiently stirred by a three one motor (produced by SHINTO Scientific Co., ltd.) under the conditions that a rotation number of a stirring blade was 210 rpm and a peripheral velocity of the stirring blade was 0.71 m/s. Thereafter, 133 parts by weight of deionized water was added into the separable flask while stirring the mixture.

Next, additional 133 parts by weight of deionized water was added to the resin solution in the separable flask drop by drop under the conditions that the temperature of the mixture in the separable flask was adjusted at 25° C. and the mixture was continued to be stirred to thereby cause phase inversion emulsification. In this way, a water-based emulsion in which a dispersoid containing the polyester resin was dispersed was obtained.

Producing Associated Particles

Next, in a state that the steering of the water-based emulsion in the flask was still being continued, 285 parts by weigh of deionized water was further added to the water-based emulsion so that a total amount of 1N ammonia water and water became 593 parts by weight. Then, 2.6 parts by weight of EMAL O (an anion type emulsifying agent produced by Kao Corporation) which was diluted by 30 parts by weight of deionized water was added into the water-based emulsion.

Thereafter, 300 parts by weight of 3.5% ammonium sulfate solution was added into the water-based emulsion drop by drop under the conditions that a temperature of the water-based emulsion was kept to be at 25° C., a rotation number of a stirring blade was 150 rpm, and a peripheral velocity of the stirring blade was 0.54 m/s. In this way, a particle size of an associated particle became 3.5 μm.

After the addition of the ammonium sulfate solution to the water-based emulsion was ended, the water-based emulsion was still continued to be stirred until the particle size of the associated particle became 5.0 μm to obtain an associated particle dispersion liquid. In this way, the production process of the associated particles was completed.

The associated particle dispersion liquid was dried under reduced pressure to remove the organic solvent (methylethylketone) to thereby obtain associated particles of the dispersoid.

In this regard, it is to be noted that an average particle size of the associated particles and an average particle size of the toner particles obtained in each of the Examples 1 to 13 and the Comparative Examples 1 to 3 were measured in the volume basis with a particle analysis apparatus ("Mastersizer 2000" produced by Malvern Instruments Ltd.). Further, a particle size distribution of the associated particle and a particle size distribution of the toner particles were also measured with the same particle analysis apparatus.

Preparation of Liquid Developer 40 parts by weight of the thus obtained associated particles, 60 parts by weight of a soy oil fatty acid methyl, 1 parts by weight of a condensation polymer of polyamine fatty acid ("Solsperse 11200" produced by Lubrizol Japan Ltd.), and 0.5 parts by weight of aluminium stearate (produced by NOF CORPORATION) were put in a ceramics pot, and then zirconia balls each having the diameter of 3 mm was added in the ceramics pot so that a volume filling factor thereof became 30%.

They were then mixed by a desk pot mill at a rotational speed of 220 rpm for 200 hours for diassociating the associated particles, to thereby obtain a toner particle dispersion liquid.

After the completion of the disassociation process, 100 parts by weight of liquid paraffin ("COSMO WHITE P-60" produced by COSMO OIL Co., Ltd.) as aliphatic hydrocarbon was added to the ceramics pot, so that an insulation liquid in which the toner particles were dispersed was obtained.

The dispersion of the toner particles was carried out by a ball mill using beads each having a diameter of 1 mm for 24 hours, and then the beads were removed. In this way, a liquid developer was obtained.

Furthermore, a magenta liquid developer, a yellow liquid developer, and a black liquid developer which are the same as those described above were produced excepting that a pigment red 122 as a magenta type pigment, a pigment yellow 180 as a yellow pigment, and a carbon black ("Printex L", produced by Degussa AG) as black pigment were respectively used instead of the cyanine pigment.

In this regard, it is to be noted that the polyester resin (softening point $T_f$ thereof was 99° C.) used in this Example of the present invention was prepared as follows. Acids, alcohols, and a catalyst as described below were put in a reaction kettle of 50 L, and then a polymerization reaction was carried out under an atmospheric pressure with nitrogen gas stream at a 210° C. for 12 hours.

Thereafter, the pressure was reduced little by little, and the reaction was continued to be carried out at a pressure of 10 mmHg. The softening point was measured based on American Society for Testing and Materials (ASTM) E28-517. And the polymerization reaction was completed at the point that the softening point got to 88° C.

| | |
|---|---|
| Terephthalic acid | 79.7 parts by weight |
| Isophthalic acid | 53.1 parts by weight |
| Ethyleneglycol | 28.6 parts by weight |
| Neopenthylglycol | 48.0 parts by weight |
| Tetrabutylthitanate | 1.0 parts by weight |

The thus obtained polyester resin had properties as follows. An appearance thereof was colorless solid, acid numbers were 10.0, a glass transition point (Tg) was 53° C., and a softening point (T½) was 99° C.

Further, a weight-average molecular weight of the polyester resin was measured under the conditions as follows by using a gel permeation chromatography (GPC) measuring device ("HLC-8120GPC" produced by TOSOH CORPORATION).

The conditions were set so that separation columns were used in combination with TSK-GEL, G5000HXL, G4000HXL, G3000HXL, and G2000HXL which are produced by TOSOH Corporation, a temperature of the columns was 40° C., a solvent to be used was tetrahydrofuran of 0.5 wt %, the pore size of a filter to be used was 0.2 μm, and a rate of the solvent was 1 ml/min. Thus obtained measured value was converted based on a standard polystyrene. As a result, the weight-average molecular weight of the polyester resin was 7,400.

Example 2

In Example 2, liquid developers of different colors were produced in the same manner as in the Example 1 except that the soy oil fatty acid methyl was changed to a rape oil fatty acid methyl which was prepared as follows.

A crude rape oil was refined in the same manner as the soy oil in the Example 1 to obtain a refined rape oil (hereinbelow, simply referred to as "rape oil"). In this regard, it is to be noted that fatty acid glyceride mainly constituted of an oleic acid component was contained in the rape oil, and an amount of an unsaturated fatty acid glyceride contained in the rape oil was 98 wt %.

An amount of the oleic acid component and an amount of a linolic acid component contained in the fatty acid glyceride were 52 mol % and 24 mol % with respect to an amount of the total fatty acid components, respectively.

Next, glycerine obtained by an ester-exchange reaction of the obtained rape oil and methanol was removed to obtain a fatty acid monoester solution.

Next, the fatty acid monoester solution was refined. In this way, an amount of a rape oil-fatty acid methyl contained in the refined fatty acid monoester solution became 99.9 wt % or higher.

Further, a viscosity of the soy oil-fatty acid methyl which was measured according to JIS Z8809 using a vibration type viscometer at a temperature of 25° C. was 3.0 mPa·s.

Example 3

In Example 3, liquid developers of different colors were produced in the same manner as in the Example 1 except that methanol used in the ester-exchange reaction was changed to ethanol. It was to be noted that an amount of a fatty acid monoester was 99.9 wt % or higher in a soy oil-fatty acid ethylester obtained by the ester-exchange reaction.

Example 4

In Example 4, liquid developers of different colors were produced in the same manner as in the Example 1 except that methanol used in the ester-exchange reaction was changed to butanol. It was to be noted that an amount of a fatty acid monoester was 99.9 wt % or higher in a soy oil-fatty acid buthylester obtained by the ester-exchange reaction.

Example 5

In Example 5, liquid developers of different colors were produced in the same manner as in the Example 1 except that the liquid paraffin was changed to silicone oil ("KF96" produced by Shin-Etsu Chemical Co., Ltd.).

Example 6

In Example 6, liquid developers of different colors were produced in the same manner as in the Example 1 except that the liquid paraffin was changed to a mixture in which liquid paraffin ("COSMO WHITE P-60" produced by COSMO OIL Co., Ltd.) and silicone oil ("KF96" produced by Shin-Etsu chemical Co., Ltd.) were mixed at a mixing rate of 1:1.

Example 7

In Example 7, liquid developers of different colors were produced in the same manner as in the Example 1 except that the liquid paraffin was changed to a soy oil refined in the same manner as in the Example 1.

Example 8

In Example 8, liquid developers of different colors were produced in the same manner as in the Example 1 except that the polyester resin was changed to a polyester resin having a softening point of 125° C. as shown in Table 1. In this regard, it is to be noted that the polyester resin was prepared as follows.

Acids, alcohols, and a catalyst as described below were put in a reaction kettle of 50 L, and then a polymerization reaction was carried out under an atmospheric pressure with nitrogen gas stream at a 210° C. for 12 hours.

Thereafter, the pressure was reduced little by little, and the reaction was continued to be carried out at a pressure of 10 mmHg. The softening point was measured based on American Society for Testing and Materials (ASTM) E28-517. And the polymerization reaction was completed at the point that the softening point got to 115° C.

| | |
|---|---|
| Terephthalic acid | 79.7 parts by weight |
| Isophthalic acid | 53.1 parts by weight |
| Ethyleneglycol | 28.6 parts by weight |
| Neopenthylglycol | 48.0 parts by weight |
| Tetrabutylthitanate | 1.0 parts by weight |

The thus obtained polyester resin had properties as follows. An appearance thereof was colorless solid, acid numbers were 10.0, a glass transition point (Tg) was 65° C., and a softening point (T½) was 125° C.

Further, a weight-average molecular weight of the polyester resin was measured under the conditions as follows by using a gel permeation chromatography (GPC) measuring device ("HLC-8120GPC" produced by TOSOH CORPORATION).

The conditions were set so that separation columns were used in combination with TSK-GEL, G5000HXL, G4000HXL, G3000HXL, and G2000HXL which are produced by TOSOH Corporation, a temperature of the columns was 40° C., a solvent to be used was tetrahydrofuran of 0.5 wt %, the pore size of a filter to be used was 0.2 μm, and a rate of the solvent was 1 ml/min. Thus obtained measured value was converted based on a standard polystyrene. As a result, the weight-average molecular weight of the polyester resin was 9,000.

Examples 9 to 11

In each of Examples 9 to 11, liquid developers of different colors were produced in the same manner as in the Example 1 except that the amount of the fatty acid monoester and the amount of the aliphatic hydrocarbon contained in the insulation liquids were respectively changed to those as shown in Table 1.

Example 12

In Example 12, liquid developers of different colors were produced in the same manner as in the Example 1 except that in the diassociating step the disassociation process was carried out using zirconia balls each having the diameter of 4 mm with the desk pot mill at a rotational speed of 330 rpm for 40 hours.

Example 13

In Example 13, liquid developers of different colors were produced in the same manner as in the Example 1 except that in the diassociating step the disassociation process was carried out using zirconia balls each having the diameter of 0.8 mm with the desk pot mill at a rotational speed of 150 rpm for 110 hours.

Comparative Example 1

In Comparative Example 1, liquid developers of different colors were produced in the same manner as in the Example 1 except that the polyester resin was changed to a epoxy resin ("EPICOAT 1004" having a softening temperature of 128° C.).

Comparative Example 2

In Comparative Example 2, liquid developers of different colors were produced in the same manner as in the Example 1 except that in the diassociating step the soy oil-fatty acid methyl was changed to a liquid paraffin ("COSMO WHITE P-60" produced by COSMO OIL Co., Ltd.).

Comparative Example 3

In Comparative Example 3, liquid developers of different colors were produced in the same manner as in the Example 1 except that in the diassociating step the soy oil fatty-acid methyl was changed to a silicone oil ("KF96" produced by Shin-Etsu chemical Co., Ltd.). For each of the Examples 1 to 13 and the Comparative Examples 1 to 3, physical properties and producing conditions of each toner particle and each insulation liquid and the like were shown in Table 1.

TABLE 1

| | Toner Particles | | | | | Insulation Liquid | | | | | |
|---|---|---|---|---|---|---|---|---|---|---|---|
| | | | | | | Fatty Acid Monoester | | Component other than Fatty Acid Monoester | | | |
| | Resin | | Average | | | | Amount of Fatty Acid | | Amount of Component other than Fatty Acid | | |
| | Kind | Softening Point [° C.] | Particle Size [μm] | Average Roundness | Index S | Kind | Monoester in Insulation Liquid: X [Wt %] | Kind | Monoester in Insulation Liquid: Z [Wt %] | X/Z | Viscosity [mPa · S] |
| Ex. 1 | Polyester Resin | 99 | 1.34 | 0.98 | 1.13 | Soy Oil-Fatty Acid Methyl | 37 | Liquid Paraffin | 63 | 0.59 | 200 |
| Ex. 2 | Polyester Resin | 99 | 1.32 | 0.98 | 1.20 | Rape Oil-Fatty Acid Methyl | 37 | Liquid Paraffin | 63 | 0.59 | 220 |
| Ex. 3 | Polyester Resin | 99 | 1.30 | 0.97 | 1.30 | Soy Oil-Fatty Acid Ethyl | 37 | Liquid Paraffin | 63 | 0.59 | 190 |
| Ex. 4 | Polyester Resin | 99 | 1.34 | 0.98 | 1.25 | Soy Oil-Fatty Acid Butyl | 37 | Liquid Paraffin | 63 | 0.59 | 200 |
| Ex. 5 | Polyester Resin | 99 | 1.33 | 0.96 | 1.34 | Soy Oil-Fatty Acid Methyl | 37 | Silicone Oil | 63 | 0.59 | 260 |
| Ex. 6 | Polyester Resin | 99 | 1.34 | 0.97 | 1.25 | Soy Oil-Fatty Acid Methyl | 37 | Liquid Paraffin/ Silicone Oil | 63 | 0.59 | 250 |
| Ex. 7 | Polyester Resin | 99 | 1.30 | 0.98 | 1.38 | Soy Oil-Fatty Acid Methyl | 37 | Soy Oil | 63 | 0.59 | 430 |
| Ex. 8 | Polyester Resin | 125 | 1.32 | 0.97 | 1.15 | Soy Oil-Fatty Acid Methyl | 37 | Liquid Paraffin | 63 | 0.59 | 200 |
| Ex. 9 | Polyester Resin | 99 | 1.34 | 0.98 | 1.28 | Soy Oil-Fatty Acid Methyl | 60 | Liquid Paraffin | 40 | 1.5 | 160 |
| Ex. 10 | Polyester Resin | 99 | 1.34 | 0.98 | 1.21 | Soy Oil-Fatty Acid Methyl | 15 | Liquid Paraffin | 85 | 0.18 | 380 |
| Ex. 11 | Polyester Resin | 99 | 1.33 | 0.96 | 1.13 | Soy Oil-Fatty Acid Methyl | 30 | Liquid Paraffin | 70 | 0.43 | 300 |
| Ex. 12 | Polyester Resin | 99 | 1.80 | 0.80 | 1.98 | Soy Oil-Fatty Acid Methyl | 37 | Liquid Paraffin | 61 | 0.61 | 200 |
| Ex. 13 | Polyester Resin | 99 | 1.90 | 0.99 | 1.36 | Soy Oil-Fatty Acid Methyl | 37 | Liquid Paraffin | 61 | 0.61 | 200 |
| Comp. Ex. 1 | Epoxy Resin | 128 | 1.27 | 0.95 | 1.18 | Soy Oil-Fatty Acid Methyl | 37 | Liquid Paraffin | 63 | 0.59 | 550 |
| Comp. Ex. 2 | Polyester Resin | 99 | 3.50 | 0.84 | 1.58 | — | — | Liquid Paraffin | 100 | — | 560 |
| Comp. Ex. 3 | Polyester Resin | 99 | 4.23 | 0.81 | 1.61 | — | — | Silicone Oil | 100 | — | 630 |

2 Evaluation

For the respective liquid developers produced as described above, the following evaluations were made.

2.1 Fixing Strength (Fixing Characteristics)

By using the image forming apparatus shown in FIG. 1 images each having a predetermined pattern were formed on recording papers (High quality paper LPCPPA4 produced by Seiko Epson Corporation) employing the liquid developers of different colors of the Examples 1 to 13 and the Comparative Examples 1 to 3, respectively. Then, the images formed on the papers were thermally fixed onto the papers using a fixing apparatus as shown in FIG. 6. The thermal fixing was carried out by setting a temperature of a heat fixing roller at 100° C.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 1.2 kgf/cm$^2$. Then, the residual rate of the image density of each recording paper was measured by a colorimeter "X-Rite model 404" (X-Rite Incorporated), and the measurement results were evaluated according to the following five criteria A to E.

A: Residual rate of the image density was 95% or higher (very good).

B: Residual rate of the image density was 90% or higher but lower than 95% (good).

C: Residual rate of the image density was 80% or higher but lower than 90% (normal).

D: Residual rate of the image density was 70% or higher but lower than 80% (bad).

E: Residual rate of the image density was lower than 70% (very bad).

2.2 Dispersibility Test

The cyan type liquid developer of 10 ml obtained in each of the Examples 1 to 13 and the Comparative Examples 1 to 3 was supplied to a centrifugation tube. After the liquid developer was separated under the conditions in which a gravitational acceleration was 1,000 G and a time was 10 minutes, a supernatant fluid of 200 μl was collected. The liquid developers used in the Examples 1 to 13 and the Comparative Examples 1 to 3 were diluted to 100 times respectively, and they were used as samples.

An absorption wavelength of each of the samples was measured using a spectrophotometer for ultraviolet and visible region (V-570 produced by JASCO Corporation).

For each of the samples, an absorbance in the absorption range for a cyan pigment (that is, at the absorption wavelength of 685 nm) was measured, and the results were evaluated according to the following four criteria A to D.

A: Absorbance at the absorption wavelength of 685 nm was 1.50 or higher (Settling of toner particles was not observed at all.)

B: Absorbance at the absorption wavelength of 685 nm was 1.00 or higher but lower than 1.50 (Settling of toner particles was scarcely observed.)

C: Absorbance at the absorption wavelength of 685 nm was 0.50 or higher but lower than 1.00 (Settling of toner particles was observed.).

D: Absorbance at the absorption wavelength of 685 nm was lower than 0.50 (A settling of toner particles was observed conspicuously, and the settling began in a state that the sample was being left in a natural condition.).

2.3 Gloss Level of Toner Images

By using the image forming apparatus shown in FIG. 1 images each having a predetermined pattern were formed on recording papers (High quality paper LPCPPA4 produced by Seiko Epson Corporation) employing the liquid developers of different colors of the Examples 1 to 13 and the Comparative Examples 1 to 3, respectively. Then, the images formed on the papers were thermally fixed onto the papers using a fixing apparatus as shown in FIG. 6. The thermal fixing was carried out by setting a temperature of a heat fixing roller at 100° C.

A gloss level of each of the images formed on the recording papers using the liquid developers of different colors obtained in the Examples 1 to 13 and the Comparative Examples 1 to 3 was measured using a gloss meter ("GM-26D" produced by MURAKAMI COLOR RESEARCH LABORATORY), and the measurement results were evaluated according to the following four criteria A to D.

A: Gloss level of the toner image on the recording paper was 7 or higher (very good).

B: Gloss level of the toner image on the recording paper was 6 or higher but lower than 7 (good).

C: Gloss level of the toner image on the recording paper was 5 or higher but lower than 6 (bad).

D: Gloss level of the toner image on the recording paper was lower than 5 (very bad).

2.4 Preservability (Storage Stability)

The liquid developers of different colors obtained in the Examples 1 to 13 and the Comparative Examples 1 to 3 were being placed (left) under the atmosphere at a temperature of 35° C. and a relative humidity of 65% for six months. Thereafter, conditions of each of the liquid developers of different colors after the six month period such as were visually observed, and the observation results including changes in its viscosity, color, acid numbers, and electrical resistance were evaluated by the following five criteria A to E.

In this regard, it is to be noted that change of color of each liquid developer was visually observed. A viscosity of each liquid developer was measured according to JIS Z8809 using a vibration type viscometer. Electric resistance of each liquid developer was measured by using Universal Electrometer MMAII-17B, electrodes for liquid LP-05, and Sealed Box P-618 (produced by Kawaguchi Electric Works Co., Ltd.).

A: Viscosity change, color change, and electric resistance change of the liquid developers of different colors were not observed at all.

B: Viscosity change, color change, and electric resistance change of the liquid developers of different colors were scarcely observed.

C: Viscosity change, color change, and electric resistance change of the liquid developers of different colors were slightly observed, but they were within the range where the liquid developers could be practically used.

D: Viscosity change, color change, and electric resistance change of the liquid developers of different colors were clearly observed.

E: Viscosity change, color change, and electric resistance change of the liquid developers of different colors were conspicuously observed.

2.5 Charge Property (Electrification Property)

A potential difference of each of the liquid developers of different colors obtained in the Examples 1 to 13 and the Comparative Examples 1 to 3 was measured by using a microscope type laser zeta potential meter (ZC-2000 produced by Microtec Nition Corporation), and the measurement results were evaluated according to the following five criteria A to E. In this regard, it is to be noted that zeta potential of each liquid developer was measured as follows.

First, each liquid developer was diluted with a solvent, and then each diluted liquid developer was put in a transparent cell of □10 mm. Next, the transparent cell was set to the microscope type laser zeta potential meter, and then a voltage of 300 V was applied between electrodes (interval therebetween was 9 mm) of the microscope type laser zeta potential meter.

At the same time, movement of the toner particles was observed with a microscope to calculate their moving speed by the microscope type laser zeta potential meter, and zeta potential of each liquid developer was obtained based on the calculated moving speed values.

A: Potential difference was +100 mV or higher (very good).

B: Potential difference was +85 mV or higher but lower than +100 mV (good).

C: Potential difference was +70 mV or higher but lower than +85 mV (normal).

D: Potential difference was +50 mV or higher but lower than +70 mV (bad).

E: Potential difference was lower than +50 mV (very bad).

2.6 Resolution

By using the image forming apparatus shown in FIG. 1 color images each having a predetermined pattern were formed on recording papers employing the liquid developers of different colors of the Examples 1 to 13 and the Comparative Examples 1 to 3, respectively. Then, the resolution of each of the color images was visually observed. These results are shown in the following Table 2.

TABLE 2

| | Fixing Strength | Dispersibility | Gloss | Preservability | Charge Property | Resolution [line/mm] |
|---|---|---|---|---|---|---|
| Ex. 1 | A | A | A | A | A | 9.8 |
| Ex. 2 | A | A | A | A | A | 9.3 |
| Ex. 3 | A | A | A | A | A | 8.6 |
| Ex. 4 | A | A | A | A | A | 8.2 |
| Ex. 5 | A | A | A | A | A | 9.8 |
| Ex. 6 | A | A | A | A | A | 8.4 |
| Ex. 7 | A | A | A | C | B | 9.3 |
| Ex. 8 | B | A | A | A | A | 8.4 |
| Ex. 9 | A | A | A | B | B | 8.9 |
| Ex. 10 | B | A | A | B | A | 8.5 |
| Ex. 11 | A | A | A | B | A | 7.0 |
| Ex. 12 | B | B | B | A | B | 7.2 |
| Ex. 13 | B | B | B | A | B | 9.7 |
| Comp. Ex. 1 | C | D | D | C | B | 7.4 |
| Comp. Ex. 2 | E | D | D | A | B | 6.8 |
| Comp. Ex. 3 | E | D | D | A | B | 5.2 |

As shown in the Table 2, the liquid developers according to the invention (that is, the liquid developers of the Examples 1 to 13) had excellent fixing strength and excellent dispersibility. Further, the liquid developers had excellent storage stability, charge property, resolution, and gloss of the obtained images. In contrast, in the liquid developers of different colors of the Comparative Examples 1 to 3, satisfactory results could not be obtained.

3 Synthesis of Resin

Straight Chain Type Polyester Resin PES1

Acids, alcohols, and a catalyst as described below were put in a reaction kettle of 50 L, and then a polymerization reaction was carried out under an atmospheric pressure with nitrogen gas stream at a 210° C. for 12 hours.

Thereafter, the pressure was reduced little by little, and the reaction was continued to be carried out at a pressure of 10 mmHg. A softening point was measured based on American Society for Testing and Materials (ASTM) E28-517. And the polymerization reaction was completed at the point that the softening point got to 95° C.

| | |
|---|---|
| Terephthalic acid | 79.7 parts by weight |
| Isophthalic acid | 53.1 parts by weight |
| Ethyleneglycol | 28.6 parts by weight |
| Neopenthylglycol | 48.0 parts by weight |
| Tetrabutylthitanate | 1.0 parts by weight |

The thus obtained polyester resin (PES1) had properties as follows. An appearance thereof was colorless solid, acid numbers were 10.0, a glass transition point (Tg) was 55° C., and a softening point (T½) was 107° C.

Further, a weight-average molecular weight of the polyester resin was measured under the conditions as follows by using a gel permeation chromatography (GPC) measuring device ("HLC-8120GPC" produced by TOSOH CORPORATION).

The conditions were set so that separation columns were used in combination with TSK-GEL, G5000HXL, G4000HXL, G3000HXL, and G2000HXL which are produced by TOSOH Corporation, a temperature of the columns was 40° C., a solvent to be used was tetrahydrofuran of 0.5 wt %, the pore size of a filter to be used was 0.2 μm, and a rate of the solvent was 1 ml/min. Thus obtained measured value was converted based on a standard polystyrene. As a result, the weight-average molecular weight of the polyester resin was 7,740.

Straight Chain Type Polyester Resin PES2

Acids, alcohols, and a catalyst as described below were put in a reaction kettle of 50 L, and then a polymerization reaction was carried out under an atmospheric pressure with nitrogen gas stream at a 210° C. for 11 hours.

Thereafter, the pressure was reduced little by little, and the reaction was continued to be carried out at a pressure of 10 mmHg. A softening point was measured based on American Society for Testing and Materials (ASTM) E28-517. And the polymerization reaction was completed at the point that the softening point got to 87° C.

| | |
|---|---|
| Terephthalic acid | 53.1 parts by weight |
| Isophthalic acid | 79.7 parts by weight |
| Ethyleneglycol | 26.0 parts by weight |
| Neopenthylglycol | 43.7 parts by weight |
| Tetrabutylthitanate | 1.0 parts by weight |

The thus obtained polyester resin (PES2) had properties as follows. An appearance thereof was colorless solid, acid numbers were 10.0, a glass transition point (Tg) was 46° C., and a softening point (T½) was 95° C. Further, a weight-average molecular weight of the polyester resin (PES2) was 5,200.

Branched-Chain Type Polyester Resin PES3

Acids, alcohols, a catalyst and the like as described below were put in a reaction kettle of 50 L, and then a polymerization reaction was carried out under an atmospheric pressure with nitrogen gas stream at a 240° C. for 12 hours.

Thereafter, the pressure was reduced little by little, and the reaction was continued to be carried out at a pressure of 10 mmHg. A softening point was measured based on American Society for Testing and Materials (ASTM) E28-517. And the polymerization reaction was completed at the point that the softening point got to 159° C.

| | | |
|---|---|---|
| Terephthalic acid | 19.4 | parts by weight |
| Isophthalic acid | 90.7 | parts by weight |
| Adipic acid | 17.1 | parts by weight |
| Ethyleneglycol | 25.4 | parts by weight |
| Neopenthylglycol | 42.6 | parts by weight |
| Tetrabutylthitanate | 1.0 | parts by weight |
| EPICLON 830 | 3.0 | parts by weight (Bisphenol F type epoxy resin (of which equivalent of epoxy was 170 g/eq), produced by DAINIPPON INK AND CHEMICALS, INCORPORATED.) |
| CARDURA E | 1.0 | parts by weight (alkyl glycidyl ester (of which equivalent of epoxy was 250 g/eq), produced by Shell Chemicals Japan Ltd) |

The thus obtained polyester resin (PES3) had properties as follows. An appearance thereof was colorless solid, acid numbers were 9.8, a glass transition point (Tg) was 40° C., and a softening point (T½) was 176° C. Further, a weight-average molecular weight of the polyester resin (PES3) was 176,000.

4 Production of Liquid Developer

Example 14

Preparation of Fatty Acid Monoester

A fatty acid monoester solution constituting an insulation liquid was prepared as follows.

First, a crude soy oil was refined as follows to obtain a finely refined soy oil. The crude soy oil was roughly refined by a low temperature crystallization method using methanol, diethylether, petroleum ether, acetone, or the like as a solvent to be used for the roughly refined.

Next, 300 parts by volume of the obtained roughly refined soy oil (first roughly refined oil) was put into a flask. And then 100 parts by volume of boiled water was poured into the flask, and thereafter the flask was closed with a plug or cap.

Next, the flask was shaken, and the roughly refined soy oil (first roughly refined oil) was mixed with the boiled water to obtain a mixture.

Next, the flask was left at rest until the mixture in the flask was separated into three layers. After the complete separation to the three layers was confirmed, the flask containing the mixture therein was placed in a refrigerator and refrigerated for 24 hours.

Thereafter, the flask was get out of the refrigerator to transfer an unfrozen component (other than the water) to another flask. With regard to the unfrozen component, the same operations as those described above were repeatedly carried out again to take out the unfrozen component to thereby obtain a roughly refined soy oil (second roughly refined oil).

Next, 100 parts by volume of the thus obtained second roughly refined oil was mixed with 35 parts by volume of an activated clay mainly constituted of aluminum silicate containing water in a flask and it was stirred to thereby obtain a mixture.

Next, the thus obtained mixture was preserved under the pressure (0.18 MPa) for 48 hours. At that time, the activated clay was completely precipitated.

Thereafter, the precipitate was removed to obtain finely refined soy oil (hereinbelow, simply referred to as "soy oil"). In this regard, it is to be noted that a fatty acid glyceride mainly constituted of a linolic acid component was contained in the soy oil.

Further, it is to be noted that an amount of an unsaturated fatty acid glyceride contained in the soy oil was 98 wt % and an amount of the linolic acid component of the fatty acid glyceride with respect to a total amount of the fatty acid was 53 mol %.

Next, the thus obtained soy oil was subjected to an ester-exchange reaction with methanol, and glycerine produced by the reaction was removed to thereby obtain a solution mainly constituted of fatty acid monoester.

Next, the solution mainly constituted of the fatty acid monoester was further refined to thereby obtain a soy oil-fatty acid methyl containing the fatty acid monoester of 99.9 wt % or higher. The thus obtained fatty acid monoester contained an unsaturated fatty acid monoester such as methyl oleate, methyl linoleate, methyl α-linolenate, and the like and a saturated fatty acid monoester such as methyl palmitate, methyl stearate, and the like.

An amount of the unsaturated fatty acid monoester contained in the fatty acid monoester was 84%. Further, a viscosity of the soy oil-fatty acid methyl measured according to JIS Z8809 using a vibration type viscometer at a temperature of 25° C. was 3.0 mPa·s.

Preparation of Coloring Agent Master Solution

First, the polyester resin PES1 and a cyan type pigment ("Pigment Blue 15:3", produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled.

The kneaded material that had been cooled as described above was coarsely ground using a hammer mill to be formed into powder having an average particle size of 1.0 mm or less.

Methylethylketone was added to the powder of the kneaded material obtained so that an amount of the powder of the kneaded material (polyester resin and pigment) became 30 wt % and then the mixture was subjected to a wet dispersion process with an aigar motor mill ("M-1000" produced by American Aigar Co., Ltd.) to prepare a coloring agent master solution.

Preparation of Resin Solution 200 parts by weight of methylethylketone and 73 parts by weight of the polyester resin were added into 33 parts by weight of the coloring agent master solution to obtain a mixture and then the mixture was stirred with an aigar motor mill ("M-1000" produced by American Aigar Co., Ltd.) to obtain a resin solution. In the resin solution, the pigment was finely dispersed homogeneously.

Preparation of Water-Based Emulsion 500 parts by weight of the resin solution and 45.5 parts by weight of methylethylketone were put into a cylindrical separable flask of 2 L having a maxblend stirring blade. It is to be noted that an amount of a solid content, namely, the pigment and the polyester resin derived from the coloring agent master solution and the polyester derived from the resin solution contained in the resin solution was 55 wt %.

Next, 41.7 parts by weight of 1N ammonia water (a mol equivalent ratio of ammonia and a total amount of carboxyl groups that the polyester resin had in a molecular structure thereof was 1.1) was added to the resin solution in the separable flask to obtain a mixture. Then, the mixture was sufficiently stirred by a three one motor (produced by SHINTO Scientific Co., ltd.) under the conditions that a rotation number of a stirring blade was 210 rpm and a peripheral velocity of the stirring blade was 0.71 m/s. Thereafter, 133 parts by weight of deionized water was added into the separable flask while stirring the mixture.

Next, additional 133 parts by weight of deionized water was added to the resin solution in the separable flask drop by drop under the conditions that the temperature of the mixture in the separable flask was adjusted at 25° C. and the mixture was continued to be stirred to thereby cause phase inversion emulsification. In this way, a water-based emulsion in which a dispersoid containing the polyester resin was dispersed was obtained.

Producing Associated Particles

Next, in a state that the steering of the water-based emulsion in the flask was still being continued, 285 parts by weigh of deionized water was further added to the water-based emulsion so that a total amount of 1N ammonia water and water became 593 parts by weight. Then, 2.6 parts by weight of EMAL O (an anion type emulsifying agent produced by Kao Corporation) which was diluted by 30 parts by weight of deionized water was added into the water-based emulsion Thereafter, 300 parts by weight of 3.5% ammonium sulfate solution was added into the water-based emulsion drop by drop under the conditions that a temperature of the water-based emulsion was kept to be at 25° C., a rotation number of a stirring blade was 150 rpm, and a peripheral velocity of the stirring blade was 0.54 m/s. In this way, a particle size of an associated particle became 3.5 μm.

After the addition of the ammonium sulfate solution to the water-based emulsion was ended, the water-based emulsion was still continued to be stirred until the particle size of the associated particle became 5.0 μm to obtain an associated particle dispersion liquid. In this way, the production process of the associated particles was completed.

The associated particle dispersion liquid was dried under reduced pressure to remove the organic solvent (methylethylketone) to thereby obtain associated particles of the dispersoid. In this regard, it is to be noted that an average particle size of the associated particles and an average particle size of the toner particles obtained in each of the Examples 14 to 19 and the Comparative Examples 4 and 5 were measured in the volume basis with a particle analysis apparatus ("Mastersizer 2000" produced by Malvern Instruments Ltd.).

Further, a particle size distribution of the associated particle and a particle size distribution of the toner particles were also measured with the same particle analysis apparatus.

Preparation of Liquid Developer 40 parts by weight of the thus obtained associated particles, 60 parts by weight of a soy oil fatty acid methyl, 1 parts by weight of a condensation polymer of polyamine fatty acid ("Solsperse 11200" produced by Lubrizol Japan Ltd.), and 0.5 parts by weight of aluminium stearate (produced by NOF CORPORATION) were put in a ceramics pot, and then zirconia balls each having the diameter of 3 mm was added in the ceramics pot so that a volume filling factor thereof became 30%. They were then mixed by a desk pot mill at a rotational speed of 220 rpm for 200 hours for diassociating the associated particles, to thereby obtain a toner particle dispersion liquid.

After the completion of the disassociation process, 100 parts by weight of a rape oil ("HIGHOLEIC RAPE OIL" produced by The Nissin Oillio Group, Ltd.) was added to the ceramics pot, so that an insulation liquid in which the toner particles were dispersed was obtained.

The dispersion of the toner particles was carried out by a ball mill using beads each having a diameter of 1 mm for 24 hours, and then the beads were removed. In this way, a liquid developer was obtained.

Furthermore, a magenta liquid developer, a yellow liquid developer, and a black liquid developer which are the same as those described above were produced excepting that a pigment red 122 as a magenta type pigment, a pigment yellow 180 as a yellow pigment, and a carbon black ("Printex L", produced by Degussa AG) as black pigment were respectively used instead of the cyanine pigment.

Example 15

In Example 15, liquid developers of different colors were produced in the same manner as in the Example 14 except that the polyester resin was changed to the PES2 synthesized described above.

Example 16

In Example 16, liquid developers of different colors were produced in the same manner as in the Example 14 except that the polyester resin was changed to a mixture in which the PES1 and the PES3 were mixed at a weight ratio of 1:4.

Example 17

In Example 17, liquid developers of different colors were produced in the same manner as in the Example 14 except that the polyester resin was changed to a mixture in which the PES2 and the PES3 were mixed at a weight ratio of 1:6.

Example 18

A crude rape oil was refined in the same manner as the soy oil in the Example 14 to obtain a finely refined rape oil (hereinbelow, simply referred to as "rape oil"). In this regard, it is to be noted that fatty acid glyceride mainly constituted of an oleic acid component was contained in the rape oil, and an amount of an unsaturated fatty acid glyceride contained in the rape oil was 98 wt %.

An amount of the oleic acid component and an amount of a linolic acid component contained in the fatty acid glyceride were 52 mol % and 24 mol % with respect to an amount of the total fatty acid components, respectively.

Next, glycerine obtained by an ester-exchange reaction of the obtained rape oil and methanol was removed to obtain a fatty acid monoester solution.

Next, the fatty acid monoester solution was refined. In this way, an amount of a rape oil-fatty acid methyl contained in the refined fatty acid monoester solution became 99.9 wt % or higher. As described above, liquid developers of different colors were produced in the same manner as in the Example 14 except that the soy oil-fatty acid methyl was changed to a rape oil-fatty acid methyl, and the rape oil was changed to a soy oil.

Example 19

In a synthesis of the polyester resin PES1, a polyester resin PES4 having amino groups was produced in the same manner as in the synthesis of the polyester resin PES1 except that hydrogen atoms of the ethylene groups of the ethyleneglycol were replaced with amino groups. The thus obtained polyester resin (PES4) had properties as follows. An appearance thereof was colorless solid, acid numbers were 10.0, a glass transition point (Tg) was 56° C., and a softening point (T½) was 108° C.

Further, a weight-average molecular weight of the polyester resin was measured under the conditions as follows by using a gel permeation chromatography (GPC) measuring device ("HLC-8120GPC" produced by TOSOH CORPORATION).

The conditions were set so that separation columns were used in combination with TSK-GEL, G5000HXL, G4000HXL, G3000HXL, and G2000HXL which are produced by TOSOH Corporation, a temperature of the columns was 40° C., a solvent to be used was tetrahydrofuran of 0.5 wt %, the pore size of a filter to be used was 0.2 μm, and a rate of the solvent was 1 ml/min. Thus obtained measured value was converted based on a standard polystyrene. As a result, the weight-average molecular weight of the polyester resin was 7,520.

In this Example 19, liquid developers of different colors were produced in the same manner as in the Example 14 except that the polyester resin PES1 was changed to the polyester resin PES4 obtained as described above.

Comparative Example 4

In Comparative Example 4, liquid developers of different colors were produced in the same manner as in the Example 14 except that in the diassociating step the soy oil-fatty acid methyl and the rape oil were changed to a liquid paraffin ("COSMO WHITE P-60" produced by COSMO OIL Co., Ltd.).

Comparative Example 5

In Comparative Example 5, liquid developers of different colors were produced in the same manner as in the Example 14 except that in the diassociating step the soy oil fatty-acid methyl and the rape oil were changed to a silicone oil ("KF96" produced by Shin-Etsu chemical Co., Ltd.). For each of the Examples 14 to 19 and the Comparative Examples 4 and 5, physical properties and producing conditions of each toner particle and each insulation liquid and the like were shown in Table 3 and Table 4.

TABLE 3

| | Toner Particles | | | | | | | |
|---|---|---|---|---|---|---|---|---|
| | | Resin | | | | | | |
| | Color | Kind | Glass Transition Point/ Softening Point [° C.] | Acid Numbers [KOH mg/g] | Average Particle Size [μm] | Average Roundness | Index S | Insulation Liquid Fatty Acid Monoester Kind |
| Ex. 14 | Y | PES1 | 55/107 | 10 | 1.33 | 0.97 | 1.13 | Soy Oil-Fatty Acid Methyl |
| | M | PES1 | 55/107 | 10 | 1.34 | 0.97 | 1.12 | Soy Oil-Fatty Acid Methyl |
| | C | PES1 | 55/107 | 10 | 1.33 | 0.97 | 1.14 | Soy Oil-Fatty Acid Methyl |
| | K | PES1 | 55/107 | 10 | 1.33 | 0.97 | 1.14 | Soy Oil-Fatty Acid Methyl |
| Ex. 15 | Y | PES2 | 46/95 | 10 | 1.32 | 0.97 | 1.17 | Soy Oil-Fatty Acid Methyl |
| | M | PES2 | 46/95 | 10 | 1.33 | 0.97 | 1.16 | Soy Oil-Fatty Acid Methyl |
| | C | PES2 | 46/95 | 10 | 1.35 | 0.97 | 1.19 | Soy Oil-Fatty Acid Methyl |
| | K | PES2 | 46/95 | 10 | 1.32 | 0.97 | 1.17 | Soy Oil-Fatty Acid Methyl |
| Ex. 16 | Y | PES1 + PES3 | 43/162 | 10 | 1.30 | 0.98 | 1.14 | Soy Oil-Fatty Acid Methyl |
| | M | PES1 + PES3 | 43/162 | 10 | 1.31 | 0.98 | 1.12 | Soy Oil-Fatty Acid Methyl |
| | C | PES1 + PES3 | 43/162 | 10 | 1.30 | 0.98 | 1.13 | Soy Oil-Fatty Acid Methyl |
| | K | PES1 + PES3 | 43/162 | 10 | 1.32 | 0.98 | 1.10 | Soy Oil-Fatty Acid Methyl |
| Ex. 17 | Y | PES2 + PES3 | 41/160 | 10 | 1.35 | 0.98 | 1.15 | Soy Oil-Fatty Acid Methyl |
| | M | PES2 + PES3 | 41/160 | 10 | 1.34 | 0.96 | 1.15 | Soy Oil-Fatty Acid Methyl |
| | C | PES2 + PES3 | 41/160 | 10 | 1.36 | 0.96 | 1.14 | Soy Oil-Fatty Acid Methyl |
| | K | PES2 + PES3 | 41/160 | 10 | 1.33 | 0.96 | 1.13 | Soy Oil-Fatty Acid Methyl |
| Ex. 18 | Y | PES1 | 55/107 | 10 | 1.37 | 0.97 | 1.17 | Rape Oil-Fatty Acid Methyl |
| | M | PES1 | 55/107 | 10 | 1.32 | 0.97 | 1.16 | Rape Oil-Fatty Acid Methyl |
| | C | PES1 | 55/107 | 10 | 1.35 | 0.97 | 1.17 | Rape Oil-Fatty Acid Methyl |
| | K | PES1 | 55/107 | 10 | 1.33 | 0.97 | 1.15 | Rape Oil-Fatty Acid Methyl |
| Ex. 19 | Y | PES4 | 56/108 | 10 | 1.34 | 0.98 | 1.16 | Soy Oil-Fatty Acid Methyl |
| | M | PES4 | 56/108 | 10 | 1.35 | 0.98 | 1.15 | Soy Oil-Fatty Acid Methyl |
| | C | PES4 | 56/108 | 10 | 1.34 | 0.98 | 1.15 | Soy Oil-Fatty Acid Methyl |
| | K | PES4 | 56/108 | 10 | 1.33 | 0.98 | 1.16 | Soy Oil-Fatty Acid Methyl |

TABLE 3-continued

| | Insulation Liquid | | | | | |
|---|---|---|---|---|---|---|
| | Fatty Acid Monoester | Component other than Fatty Acid Monoester | | | | |
| | Amount of Fatty Acid Monoester in Insulation Liquid: X [Wt %] | Kind | Amount of Component other than Fatty Acid Monoester in Insulation Liquid: Z [Wt %] | X/Z | Viscosity [mPa · S] | Viscosity of Liquid Developer [mPa · S] |
| Ex. 14 | 37 | Rape Oil | 63 | 0.59 | 100 | 130 |
| | 37 | Rape Oil | 63 | 0.59 | 100 | 350 |
| | 37 | Rape Oil | 63 | 0.59 | 100 | 240 |
| | 37 | Rape Oil | 63 | 0.59 | 100 | 160 |
| Ex. 15 | 37 | Rape Oil | 63 | 0.59 | 100 | 140 |
| | 37 | Rape Oil | 63 | 0.59 | 100 | 355 |
| | 37 | Rape Oil | 63 | 0.59 | 100 | 230 |
| | 37 | Rape Oil | 63 | 0.59 | 100 | 150 |
| Ex. 16 | 37 | Rape Oil | 63 | 0.59 | 100 | 130 |
| | 37 | Rape Oil | 63 | 0.59 | 100 | 340 |
| | 37 | Rape Oil | 63 | 0.59 | 100 | 230 |
| | 37 | Rape Oil | 63 | 0.59 | 100 | 150 |
| Ex. 17 | 37 | Rape Oil | 63 | 0.59 | 100 | 130 |
| | 37 | Rape Oil | 63 | 0.59 | 100 | 320 |
| | 37 | Rape Oil | 63 | 0.59 | 100 | 230 |
| | 37 | Rape Oil | 63 | 0.59 | 100 | 150 |
| Ex. 18 | 37 | Soy Oil | 63 | 0.59 | 200 | 240 |
| | 37 | Soy Oil | 63 | 0.59 | 200 | 410 |
| | 37 | Soy Oil | 63 | 0.59 | 200 | 320 |
| | 37 | Soy Oil | 63 | 0.59 | 200 | 230 |
| Ex. 19 | 37 | Rape Oil | 63 | 0.59 | 100 | 170 |
| | 37 | Rape Oil | 63 | 0.59 | 100 | 370 |
| | 37 | Rape Oil | 63 | 0.59 | 100 | 220 |
| | 37 | Rape Oil | 63 | 0.59 | 100 | 190 |

TABLE 4

| | | Toner Particles | | | | | | Insulation Liquid | | | | | | |
|---|---|---|---|---|---|---|---|---|---|---|---|---|---|---|
| | | | Resin | | | | | Fatty Acid Monoester | | Component other than Fatty Acid Monoester | | | | |
| | Color | Kind | Glass Transition Point/ Softening Point [° C.] | Acid Numbers [KOH mg/g] | Average Particle Size [μm] | Average Round-ness | Index S | Kind | Amount of Fatty Acid Monoester in Insulation Liquid: X [Wt %] | Kind | Amount of Component other than Fatty Acid Monoester in Insulation Liquid: Z [Wt %] | X/Z | Viscosity [mPa · S] | Viscosity of Liquid Developer [mPa · S] |
| Comp. Ex. 4 | Y | PES1 | 55/107 | 10 | 3.51 | 0.83 | 1.60 | — | — | Liquid Paraffin | 100 | — | 560 | 620 |
| | M | PES1 | 55/107 | 10 | 3.54 | 0.83 | 1.58 | — | — | Liquid Paraffin | 100 | — | 560 | 820 |
| | C | PES1 | 55/107 | 10 | 3.52 | 0.83 | 1.59 | — | — | Liquid Paraffin | 100 | — | 560 | 670 |
| | K | PES1 | 55/107 | 10 | 3.54 | 0.83 | 1.60 | — | — | Liquid Paraffin | 100 | — | 560 | 640 |
| Comp. Ex. 5 | Y | PES1 | 55/107 | 10 | 4.26 | 0.80 | 1.58 | — | — | Silicone Oil | 100 | — | 630 | 700 |
| | M | PES1 | 55/107 | 10 | 4.25 | 0.80 | 1.62 | — | — | Silicone Oil | 100 | — | 630 | 940 |
| | C | PES1 | 55/107 | 10 | 4.30 | 0.80 | 1.57 | — | — | Silicone Oil | 100 | — | 630 | 780 |
| | K | PES1 | 55/107 | 10 | 4.26 | 0.80 | 1.59 | — | — | Silicone Oil | 100 | — | 630 | 740 |

5 Evaluation

For the respective liquid developers produced in Examples 14 to 19 and Comparative Examples 4 and 5 as described above, the following evaluations were made.

5.1 Fixing Strength (Fixing Characteristics)

By using the image forming apparatus shown in FIG. 7 and FIG. 8 images each having a predetermined pattern were formed on recording papers (High quality paper LPCPPA4 produced by Seiko Epson Corporation) employing the liquid developers of different colors of the Examples 14 to 19 and the Comparative Examples 4 and 5, respectively. Then, the images formed on the papers were thermally fixed onto the papers using a fixing apparatus as shown in FIG. 6. The thermal fixing was carried out by setting a temperature of a heat fixing roller at 100° C.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 1.5 kgf/cm$^2$. Then, the residual rate of the image density of each recording paper was measured by a calorimeter "X-Rite model 404" (X-Rite Incorporated), and the measurement results were evaluated according to the following five criteria A to E.

A: Residual rate of the image density was 95% or higher (very good).

B: Residual rate of the image density was 90% or higher but lower than 95% (good).

C: Residual rate of the image density was 80% or higher but lower than 90% (normal).

D: Residual rate of the image density was 70% or higher but lower than 80% (bad).

E: Residual rate of the image density was lower than 70% (very bad).

5.2 Dispersibility Test

The cyan type liquid developer of 10 ml obtained in each of the Examples 14 to 19 and the Comparative Examples 4 and 5 was supplied to a centrifugation tube. After the liquid developer was separated under the conditions in which a gravitational acceleration was 1,000 G and a time was 10 minutes, a supernatant fluid of 200 μl was collected. The liquid developers used in the Examples 14 to 19 and the Comparative Examples 4 and 5 were diluted to 100 times respectively, and they were used as samples.

An absorption wavelength of each of the samples was measured using a spectrophotometer for ultraviolet and visible region (V-570 produced by JASCO Corporation).

For each of the samples, an absorbance in the absorption range for a cyan pigment (that is, at the absorption wavelength of 685 nm) was measured, and the results were evaluated according to the following four criteria A to D.

A: Absorbance at the absorption wavelength of 685 nm was 1.50 or higher (Settling of toner particles was not observed at all.).

B: Absorbance at the absorption wavelength of 685 nm was 1.00 or higher but lower than 1.50 (Settling of toner particles was scarcely observed.).

C: Absorbance at the absorption wavelength of 685 nm was 0.50 or higher but lower than 1.00 (Settling of toner particles was observed.).

D: Absorbance at the absorption wavelength of 685 nm was lower than 0.50 (A settling of toner particles was observed conspicuously, and the settling began in a state that the sample was being left in a natural condition.).

5.3 Gloss Level of Toner Images

By using the image forming apparatus as shown in FIG. 7 and FIG. 8 images each having a predetermined pattern were formed on recording papers (High quality paper LPCPPA4 produced by Seiko Epson Corporation) employing the liquid developers of different colors of the Examples 14 to 19 and the Comparative Examples 4 and 5, respectively. Then, the images formed on the papers were thermally fixed onto the papers using a fixing apparatus as shown in FIG. 6. The thermal fixing was carried out by setting a temperature of a heat fixing roller at 100° C.

A gloss level of each of the images formed on the recording papers using the liquid developers of different colors obtained in the Examples 14 to 19 and the Comparative Examples 4 and 5 was measured using a gloss meter ("GM-26D" produced by MURAKAMI COLOR RESEARCH LABORATORY), and the measurement results were evaluated according to the following four criteria A to D.

A: Gloss level of the toner image on the recording paper was 7 or higher (very good).

B: Gloss level of the toner image on the recording paper was 6 or higher but lower than 7 (good).

C: Gloss level of the toner image on the recording paper was 5 or higher but lower than 6 (bad).

D: Gloss level of the toner image on the recording paper was lower than 5 (very bad).

5.4 Preservability (Storage Stability)

The liquid developers of different colors obtained in the Examples 14 to 19 and the Comparative Examples 4 and 5 were being placed (left) under the atmosphere at a temperature of 35° C. and a relative humidity of 65% for six months. Thereafter, conditions of each of the liquid developers of different colors after the six month period such as were visually observed, and the observation results including changes in its viscosity, color, acid numbers, and electrical resistance were evaluated by the following five criteria A to E.

In this regard, it is to be noted that change of color of each liquid developer was visually observed. A viscosity of each liquid developer was measured according to JIS Z8809 using a vibration type viscometer. Electric resistance of each liquid developer was measured by using Universal Electrometer MMAII-17B, electrodes for liquid LP-05, and Sealed Box P-618 (produced by Kawaguchi Electric Works Co., Ltd.).

A: Viscosity change, color change, and electric resistance change of the liquid developers of different colors were not observed at all.

B: Viscosity change, color change, and electric resistance change of the liquid developers of different colors were scarcely observed.

C: Viscosity change, color change, and electric resistance change of the liquid developers of different colors were slightly observed, but they were within the range where the liquid developers could be practically used.

D: Viscosity change, color change, and electric resistance change of the liquid developers of different colors were clearly observed.

E: Viscosity change, color change, and electric resistance change of the liquid developers of different colors were conspicuously observed.

5.5 Charge Property (Electrification Property)

A potential difference of each of the liquid developers of different colors obtained in the Examples 14 to 19 and the Comparative Examples 4 and 5 was measured by using a microscope type laser zeta potential meter (ZC-2000 produced by Microtec Nition Corporation), and the measurement results were evaluated according to the following five criteria A to E. In this regard, it is to be noted that zeta potential of each liquid developer was measured as follows.

First, each liquid developer was diluted with a solvent, and then each diluted liquid developer was put in a transparent cell of □10 mm. Next, the transparent cell was set to the microscope type laser zeta potential meter, and then a voltage of 300 V was applied between electrodes (interval therebetween was 9 mm) of the microscope type laser zeta potential meter.

At the same time, movement of the toner particles was observed with a microscope to calculate their moving speed by the microscope type laser zeta potential meter, and zeta potential of each liquid developer was obtained based on the calculated moving speed values.

A: Potential difference was +120 mV or higher (very good).

B: Potential difference was +100 mV or higher but lower than +120 mV (good).

C: Potential difference was +70 mV or higher but lower than +100 mV (normal).

D: Potential difference was +50 mV or higher but lower than +70 mV (bad).

E: Potential difference was lower than +50 mV (very bad).

5.6 Resolution

By using the image forming apparatus as shown in FIG. 7 and FIG. 8 color images each having a predetermined pattern were formed on recording papers employing the liquid developers of different colors of the Examples 14 to 19 and the Comparative Examples 4 and 5, respectively. Then, the resolution of each of the color images was visually observed. These results are shown in the following Table 5.

TABLE 5

| | Color | Fixing Strength | Dispersibility | Gloss | Preservability | Charge Property | Resolution [line/mm] |
|---|---|---|---|---|---|---|---|
| Ex. 14 | Y | A | A | A | A | A | 9.7 |
| | M | A | A | A | A | A | 9.6 |
| | C | A | A | A | A | A | 9.7 |
| | K | A | A | A | A | A | 9.8 |
| Ex. 15 | Y | A | A | A | A | A | 9.6 |
| | M | A | A | A | A | A | 9.5 |
| | C | A | A | A | A | A | 9.8 |
| | K | A | A | A | A | A | 9.7 |
| Ex. 16 | Y | A | A | A | A | A | 9.7 |
| | M | A | A | A | A | A | 9.5 |
| | C | A | A | A | A | A | 9.7 |
| | K | A | A | A | A | A | 9.9 |
| Ex. 17 | Y | A | A | A | A | A | 9.2 |
| | M | A | A | A | A | A | 9.7 |
| | C | A | A | A | A | A | 9.4 |
| | K | A | A | A | A | A | 9.4 |
| Ex. 18 | Y | A | A | A | A | A | 9.8 |
| | M | A | A | A | A | A | 9.6 |
| | C | A | A | A | A | A | 9.7 |
| | K | A | A | A | A | A | 9.8 |

TABLE 5-continued

| | Color | Fixing Strength | Dispersibility | Gloss | Preservability | Charge Property | Resolution [line/mm] |
|---|---|---|---|---|---|---|---|
| Ex. 19 | Y | A | A | A | A | A | 9.4 |
| | M | A | A | A | A | A | 9.4 |
| | C | A | A | A | A | A | 9.6 |
| | K | A | A | A | A | A | 9.7 |
| Comp. Ex. 4 | Y | E | D | D | A | B | 6.5 |
| | M | E | D | D | A | B | 6.7 |
| | C | E | D | D | A | B | 6.4 |
| | K | E | D | D | A | B | 6.8 |
| Comp. Ex. 5 | Y | E | D | D | A | B | 5.7 |
| | M | E | D | D | A | B | 5.2 |
| | C | E | D | D | A | B | 5.5 |
| | K | E | D | D | A | B | 5.6 |

As shown in the Table 5, the liquid developers according to the invention (that is, the liquid developers of the Examples 14 to 19) had excellent fixing strength and excellent dispersibility. Further, the liquid developers had excellent storage stability, charge property, resolution, and gloss of the obtained images. Further, color images which were formed by using the liquid developers of different colors obtained in the Examples 14 to 19 were clear and uneven color images.

In contrast, in the liquid developers of different colors of the Comparative Examples 4 and 5, satisfactory results could not be obtained.

What is claimed is:

1. A liquid developer comprising an insulation liquid containing a fatty acid monoester, and toner particles comprised of a polyester resin, wherein the toner particles are characterized in that:

an average particle size of the toner particles is in the range of 0.7 to 3 μm;

an average roundness R of the toner particles represented by the following formula (I) is in the range of 0.85 to 0.98, $$R=L_0/L_1 \quad \text{(I)}$$

wherein $L_1$ [μm] represents a circumferential length of a projected image of a toner particle that is a subject of measurement, and $L_0$ [μm] represents a circumferential length of a perfect circle having the same area as that of the projected image of the toner particle that is the subject of the measurement; and when a particle size distribution of the toner particles is measured in the volume basis to obtain a frequency distribution curve of the particle size distribution of the toner particles, an index S which indicates a sharpness of the frequency distribution curve of the particle size distribution of the toner particles represented by the following formula (II) is 1.4 or less, $$S=[D(90)-D(10)]/D(50) \quad \text{(II)}$$

wherein in the case where a cumulative distribution curve of the particle size distribution is plotted using a graph in which the ordinate axis represents a relative amount of the toner particles (%) with respect to the total amount of all the toner particles (100%) and the abscissa axis represents a particle size of a toner particle (μm), each of D(90), D(50) and D(10) respectively represents a particle size of a toner particle at a point of each of 90%, 50% and 10% of the relative amount of the toner particles in the cumulative distribution curve.

2. The liquid developer as claimed in claim 1, wherein the insulation liquid further contains at least one of an aliphatic hydrocarbon and silicone oil in addition to the fatty acid monoester.

3. The liquid developer as claimed in claim 1, wherein an amount of the fatty acid monoester contained in the insulation liquid is in the range of 5 to 55 wt %.

4. The liquid developer as claimed in claim 1, wherein the fatty acid monoester exists at the vicinity of a surface of each of the toner particles in an unevenly distributed manner.

5. The liquid developer as claimed in claim 1, wherein the fatty acid monoester is an ester obtained from a fatty acid and a monovalent alcohol having 1 to 4 carbon atoms.

6. The liquid developer as claimed in claim 1, wherein the viscosity of the liquid developer which is measured according to JIS Z8809 using a vibration type viscometer at a temperature of 25° C. is in the range of 50 to 1000 mPa·s.

7. An image forming apparatus, comprising:

a plurality of developing sections for forming a plurality of monochromatic color images using a plurality of liquid developers of different colors;

a transfer section to which the plurality of monochromatic color images formed by the developing sections are sequentially transferred onto a recording medium while transferring the recording medium to form an unfixed image onto the recording medium by overlaying the transferred monochromatic color images one after another; and a fixing device for fixing the unfixed image onto the recording medium, wherein each of the plurality of liquid developers of different colors comprises an insulation liquid containing a fatty acid monoester and toner particles comprised of a polyester resin, wherein the toner particles are characterized in that:

an average particle size of the toner particles is in the range of 0.7 to 3 μm;

an average roundness R of the toner particles represented by the following formula (I) is in the range of 0.85 to 0.98, $$R=L_0/L_1 \quad \text{(I)}$$

wherein $L_1$ [μm] represents a circumferential length of a projected image of a toner particle that is a subject of measurement, and $L_0$ [μm] represents a circumferential length of a perfect circle having the same area as that of the projected image of the toner particle that is the subject of the measurement; and when a particle size distribution of the toner particles is measured in the volume basis to obtain a frequency distribution curve of the particle size distribution of the toner particles, an index S which indicates a sharpness of the frequency distribution curve of the particle size distribution of the toner particles represented by the following formula (II) is 1.4 or less, $$S=[D(90)-D(10)]/D(50) \quad \text{(II)}$$

wherein in the case where a cumulative distribution curve of the particle size distribution is plotted using a graph in which the ordinate axis represents a relative amount of the toner particles (%) with respect to the total amount of all the toner particles (100%) and the abscissa axis represents a particle size of a toner particle (μm), each of D(90), D(50) and D(10) respectively represents a particle size of a toner particle at a point of each of 90%, 50% and 10% of the relative amount of the toner particles in the cumulative distribution curve.

8. The image forming apparatus as claimed in claim 7, wherein each of the plurality of developing sections includes at least a developing roller having a surface on which a layer of the liquid developer is to be formed, a pressing unit which unevenly distributes the toner particles included in the layer at the vicinity of the surface of the layer, and a photoreceptor having a surface on which the corresponding monochromatic color image is to be formed by transferring the liquid developer on the developing roller.

9. The image forming apparatus as claimed in claim 8, wherein the pressing unit unevenly distributes the toner particles contained in the layer at the vicinity of the surface of the layer by applying an electrical field of a same polarity as that of the toner particles to the layer.

10. The image forming apparatus as claimed in claim 7, wherein each of the plurality of developing sections includes at least a developing roller having a surface on which a layer of the liquid developer is to be formed, a photoreceptor having a surface on which the corresponding monochromatic color image is to be formed by transferring the liquid developer on the developing roller, and an application roller which supplies the liquid developer to the developing roller, and wherein the application roller is of a type as Aniloxs Roller having a surface having grooves, and wherein the liquid developer is carried in the groves and thereby the liquid developer is supplied to the developing roller.

11. The image forming apparatus as claimed in claim 10, wherein the grooves formed on the surface of the application roller are formed inclinedly with respect to a rotational direction of the application roller.

12. An image forming apparatus, comprising:

a plurality of developing sections for forming a plurality of monochromatic color images using a plurality of liquid developers of different colors;

an intermediate transfer section to which the plurality of monochromatic color images formed by the developing sections are sequentially transferred to form an intermediate transfer image which is formed by overlaying the transferred monochromatic color images one after another;

a secondary transfer section for transferring the intermediate transfer image onto a recording medium to form an unfixed image onto the recording medium, and a fixing device for fixing the unfixed image onto the recording medium, wherein each of the plurality of liquid developers of different colors comprises an insulation liquid containing a fatty acid monoester and toner particles comprised of a polyester resin, wherein the toner particles are characterized in that:

an average particle size of the toner particles is in the range of 0.7 to 3 μm;

an average roundness R of the toner particles represented by the following formula (I) is in the range of 0.85 to 0.98, wherein $L_1$ [μm] represents a circumferential length of a projected image of a toner particle that is a subject of measurement, and $L_0$ [μm] represents a circumferential length of a perfect circle having the same area as that of the projected image of the toner particle that is the subject of the measurement; and when a particle size distribution of the toner particles is measured in the volume basis to obtain a frequency distribution curve of the particle size distribution of the toner particles, an index S which indicates a sharpness of the frequency distribution curve of the particle size distribution of the toner particles represented by the following formula (II) is 1.4 or less, $$S=[D(90)-D(10)]/D(50) \quad \text{(II)}$$

wherein in the case where a cumulative distribution curve of the particle size distribution is plotted using a graph in which the ordinate axis represents a relative amount of the toner particles (%) with respect to the total amount of all the toner particles (100%) and the abscissa axis represents a particle size of a toner particle (μm), each of D(90), D(50) and D(10) respectively represents a particle size of a toner particle at a point of each of 90%, 50% and 10% of the relative amount of the toner particles in the cumulative distribution curve.

* * * * *

UNITED STATES PATENT AND TRADEMARK OFFICE

CERTIFICATE OF CORRECTION

PATENT NO. : 8,080,355 B2
APPLICATION NO. : 12/032568
DATED : December 20, 2011
INVENTOR(S) : Teshima et al.

It is certified that error appears in the above-identified patent and that said Letters Patent is hereby corrected as shown below:

On the Title page, in the Inventors section 75 of the patent, please correct the following error:

Shiojri should be corrected to read Shiojiri

Signed and Sealed this
Tenth Day of July, 2012

David J. Kappos

David J. Kappos
*Director of the United States Patent and Trademark Office*